US007267158B2

(12) United States Patent
Kolek et al.

(10) Patent No.: US 7,267,158 B2
(45) Date of Patent: Sep. 11, 2007

(54) CONTROL OF OXIDE GROWTH ON MOLTEN ALUMINUM DURING CASTING USING A HIGH MOISTURE ATMOSPHERE

(75) Inventors: Paula L. Kolek, Tarentum, PA (US); David H. DeYoung, Export, PA (US); David J. Roha, Greensburg, PA (US); Patricia A. Stewart, Pittsburgh, PA (US); Michael A. Easley, Arnold, PA (US); Jorge A. Ramos Cruz, Vandergrift, PA (US); Larry F. Wieserman, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 241 days.

(21) Appl. No.: 10/612,866

(22) Filed: Jul. 2, 2003

(65) Prior Publication Data

US 2005/0000677 A1 Jan. 6, 2005

(51) Int. Cl.
*B22D 11/10* (2006.01)
*C22B 21/06* (2006.01)

(52) U.S. Cl. ..... 164/459; 164/418

(58) Field of Classification Search ..... 164/444, 164/459, 418, 448, 428
See application file for complete search history.

(56) References Cited

U.S. PATENT DOCUMENTS 2,160,812 A * 6/1939 Alden et al. ..... 75/681
3,515,546 A * 6/1970 Greenewald, Jr. ..... 148/549
3,849,119 A * 11/1974 Bruno et al. ..... 75/678
3,855,086 A 12/1974 Sleppy et al.
4,166,495 A 9/1979 Yu
4,273,180 A 6/1981 Tertishnikov et al.
4,534,807 A 8/1985 Field et al.
4,607,679 A 8/1986 Tsai et al.
4,659,377 A 4/1987 Foerster
4,709,740 A 12/1987 Jacoby et al.
4,858,674 A 8/1989 Enright
4,987,950 A 1/1991 Yu
5,421,856 A 6/1995 Lazcano-Navarro
6,398,844 B1 6/2002 Hobbs et al.
6,412,164 B1 7/2002 DeYoung et al.

FOREIGN PATENT DOCUMENTS

EP 0 268 841 A1 6/1988

(Continued)

OTHER PUBLICATIONS

C. N. Cochran et al., Oxidation of Aluminum-Magnesium Melts in Air, Oxygen, Flue Gas, and Carbon Dioxide, Metallurgical Transactions B, vol. 8B, Jun. 1977, pp. 323-332.

*Primary Examiner*—Len Tran
(74) *Attorney, Agent, or Firm*—Greenberg Traurig LLP; Peter J. Borghetti

(57) ABSTRACT

A method of producing aluminum castings which includes the steps of casting a molten alloy, contacting the surface of the molten alloy with a humidified atmosphere and solidifying the alloy. The method is particularly suited for aluminum-magnesium alloys such as AA 5XXX and 7XXX series alloys. In addition to reducing the thickness of the surface oxide layer formed during casting, the method also provides improved surface quality of cast products and reduces subsequent remedial re-work or scalping. An improved aluminum-magnesium cast alloy product is also disclosed.

28 Claims, 20 Drawing Sheets

FOREIGN PATENT DOCUMENTS

| | | | |
|---|---|---|---|
| EP | 0 726 114 A2 | | 8/1996 |
| JP | 53-14624 | * | 2/1978 |
| JP | 61-186159 | * | 8/1986 |
| JP | 2-37954 | * | 2/1990 |
| JP | 2-274846 | * | 11/1990 |
| JP | 2002-292456 | * | 10/2005 |

* cited by examiner

CONTROL OF OXIDE GROWTH ON MOLTEN ALUMINUM DURING CASTING USING A HIGH MOISTURE ATMOSPHERE

FIELD OF THE INVENTION

The present invention relates generally to aluminum alloy processing techniques and, more particularly, to improving the surface quality of cast aluminum products by contacting the molten surface of the aluminum alloy with a humidified atmosphere during the casting process.

BACKGROUND OF THE INVENTION

It is well known in the aluminum casting art that surface imperfections, such as pits, vertical folds and oxide formations, that form during ingot casting can develop into cracks during casting or subsequent processing steps. Material that exhibits cracks often requires expensive remedial rework to salvage the material, or outright scrapping of the material if the cracking is extensive. Most cast aluminum alloys are worked subsequent to casting, by various operations well known in the casting art to include: hot rolling, cold rolling, extruding, forging, drawing, ironing, aging, forming and stretching. However, working an alloy will not eliminate, or even reduce, surface cracks. One method of mechanically removing surface defects from an aluminum alloy ingot is scalping. Scalping is an expensive process that involves milling or machining off a surface layer along the surface of an ingot after it has solidified. If methods such as scalping are unsuccessful, the cracked ingot must be re-melted and re-cast, as defective ingots cannot be processed further and have little commercial value. Surface imperfections in aluminum cast ingots remain a significant problem in the alloy art.

In the past, control of surface defects has been accomplished by the intentional introduction of alloying elements or a protective blanketing gas to the casting process. However, many of the commonly used alloying elements added to limit surface defects have considerable drawbacks. Calcium, as well as sodium, can enhance edge cracking problems. Beryllium, another commonly added alloying element, has been banned from aluminum products used for food and beverage packaging. Blanketing gases, such as dichlorodifluoromethane, carbon dioxide, sulfur dioxide, sulfuryl fluoride, nitrogen trifluoride, sulfuryl chloride fluoride, sulfur oxifluoride and nitrosyl fluoride have been used as a means of limiting surface defects by varying the atmospheric conditions present during the casting process, however, the use of such gases poses health and environmental problems such as toxicity, breathing discomfort for personnel, residual sludge disposal concerns, corrosive atmosphere and green house gas global warming concerns.

There remains a need for an effective, inexpensive and clean alternative to the addition of alloying elements or blanketing gases having environmental concerns to prevent surface defects such as vertical folds, pits, oxide patches and the like from forming during the casing process.

SUMMARY OF THE INVENTION

The present invention is directed to the addition of forced humid gas over the surface of a molten aluminum alloy during the casting process to improve the surface properties of the resulting cast product. In one embodiment, contacting the surface of an aluminum-magnesium alloy with a humidified atmosphere during the molten state results in improved surface appearance and substantially reduces surface imperfections and/or surface oxidation. Continuously exposing the molten alloy surface to humidified conditions substantially eliminates vertical folds, pits and cracking in the cast product. As a result, ingots and products cast by the method of this invention could be worked directly out of the casting process without first conditioning the surface, thereby saving considerable processing costs.

It is an aspect of the present invention to provide a method of improving the surface properties of cast aluminum alloys that includes the steps of providing a molten aluminum alloy, contacting a surface of the molten aluminum alloy with an effective humidified atmosphere, and solidifying the molten aluminum alloy.

It is a further aspect of the present invention to provide a method for limiting the growth of surface oxide on aluminum-magnesium alloys comprising the steps of providing a molten aluminum alloy having at least 0.1 wt. % magnesium, contacting a surface of the molten aluminum to a humidified atmosphere having a moisture content above about 0.005 kg/m$^3$, and solidifying the molten aluminum alloy.

It is a further aspect of the present invention to provide a cast aluminum-magnesium alloy product comprising at least about 0.1 wt. % Mg, and up to about 50 wt. % Mg, wherein the cast product has a surface oxide layer comprising magnesium oxide, magnesium hydroxide, magnesium oxy/hydroxide, aluminum oxide and/or other spinel forms of oxides.

It is still a further aspect of this invention to provide an apparatus for casting an aluminum alloy comprising a molten aluminum containment vessel, and a humidified gas injector in flow communication with the containment vessel. The gas injector is capable of providing a continuous supply of humidified air during casting.

These and other aspects of the present invention will be more apparent from the following description.

DETAILED DESCRIPTION OF PREFERRED EMBODIMENTS

Figure 1:
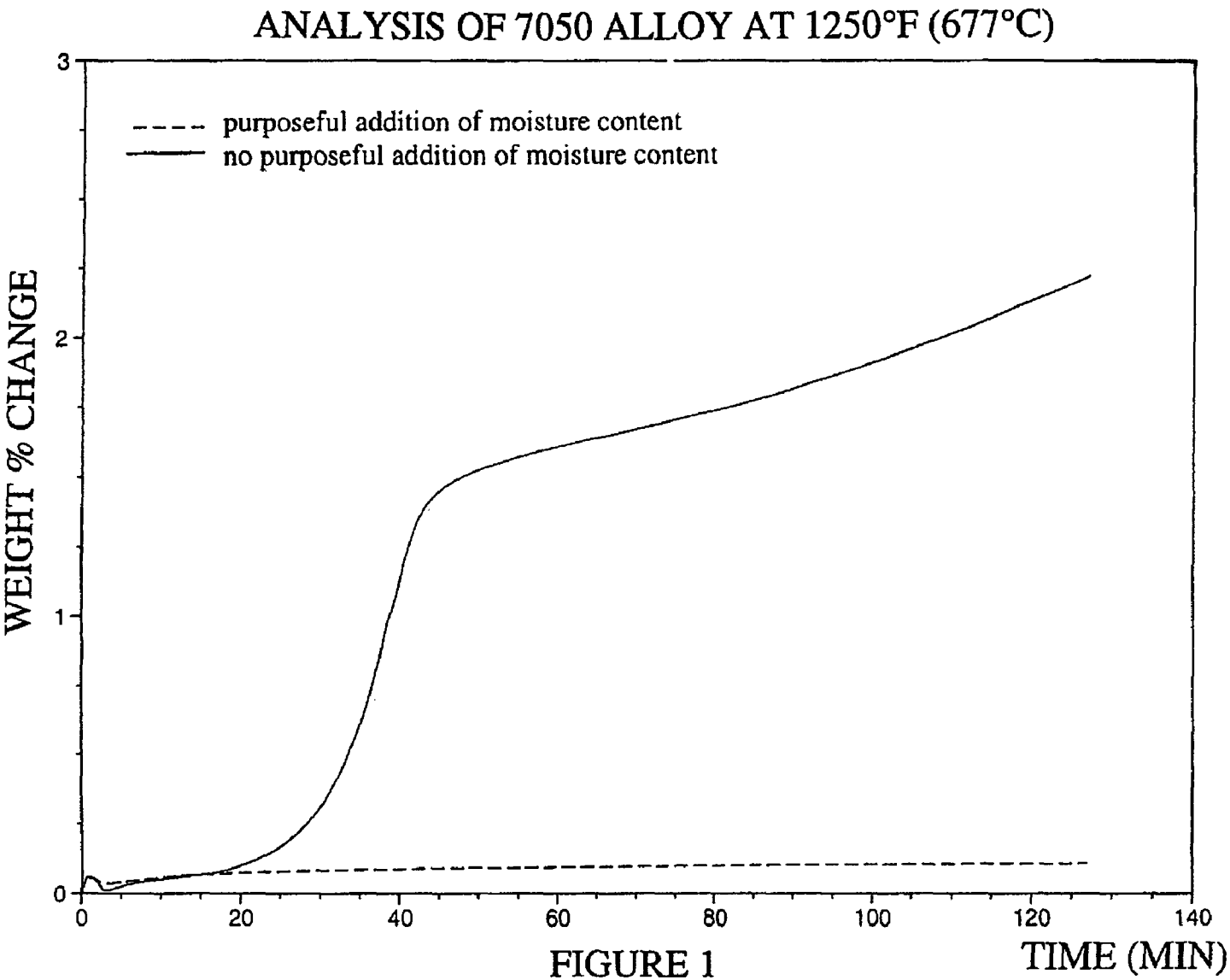
FIG. 1 is a graph showing the wt. % change over time for a 7050 alloy cast at 1,250° F. (677° C.) in atmospheres having a purposeful addition of moisture content and no purposeful addition of moisture content.

When referring to any numerical value, or range of values throughout this description and accompanying claims, it is to be understood that each range expressly includes every full and fractional number between the stated range maximum and minimum. Other than in the operating examples, or where otherwise indicated, all numbers of expressions referring to quantities of ingredients, reaction conditions, etc., used in the specification and claims are to be understood as modified in all instances by the term "about."

Aluminum-magnesium alloys tend to oxidize more rapidly than aluminum alloys that are substantially free of magnesium. Typical magnesium-free aluminum alloys oxidize slowly under normal melt conditions because a protective aluminum oxide film forms on the surface of the melt. Aluminum-magnesium alloys under the same melt conditions oxidize substantially faster due to the formation of magnesium oxide on the surface of the melt, and can result in severe melt losses, for example magnesium, and the formation of oxide inclusions that can cause subsequent fabricating difficulties. An example of such other features in the final product include pinholes, dark streaks and cracks.

In one aspect, an aluminum alloy comprising at least 0.1 wt. % magnesium is cast in accordance with the method of this invention to provide a product that exhibits a significantly thinner layer of surface magnesium oxide compared with conventionally cast aluminum-magnesium alloys. This decrease in surface oxide provides for significant improvements in subsequent re-work time and expense since the oxide layer of the present invention is considerably thinner than the oxide layer formed using conventional casting processes. Reducing the thickness of the oxide layer will eliminate features on the ingot surface such as vertical folds and pits, oxide patches and other surface imperfections that often lead to ingot cracking.

Casting aluminum alloys in high humidity conditions further improves the surface brightness of the resulting cast product. Increased surface brightness is particularly advantageous because it substantially decreases the alloy product's susceptibility to promoting premature tool wear.

The present method includes the steps of casting the aluminum alloy using any commonly used casting technique, contacting the surface of the molten alloy with a humidified atmosphere and solidifying the alloy. The alloy may be contacted with the humidified atmosphere at any and all suitable stages during the casting process, including the stage of solidifying the alloy sufficient to form a shell having a thickness sufficient to prevent a breakthrough egress of molten alloy.

An embodiment of the present invention provides a method for casting aluminum-magnesium alloys using high humidity conditions during the casting process. The present invention provides for a significantly improved surface quality of cast products, such as aluminum-magnesium alloys.

In accordance with the present invention, aluminum alloys may be cast using any conventional casting technique. Such casting techniques include direct chill casting, electromagnetic casting, horizontal direct chill casting, hot top casting, continuous casting, semi-continuous casting, belt casting, die casting, roll casting, slab casting, sand casting, centrifugal casting, lost foam casting, permanent mold casting, plaster casting, pressure die casting, vacuum casting and other methods known to those skilled in the art. The method of this invention is suitable for use with both open and closed top facilities and casting processes. Casting is preferably performed at temperatures of between the solidus temperature for the particular alloy and about 300° F. (149° C.) above the liquidus temperature for the particular alloy. In one embodiment, casting is performed at temperatures from about 10° F. (−12° C.) above the solidus temperature for the particular alloy and about 200° F. (93° C.) above the liquidus temperature for the particular alloy. The liquidus temperature varies among alloys depending on the types and amounts of alloying additions.

During the casting process, the surface of the molten aluminum alloy is contacted with a humidified atmosphere. As used herein, the term "molten aluminum alloy" means a body of aluminum alloy, at least a portion of which is molten, e.g., in the liquid state. Aluminum alloys may comprise any of the Aluminum Association ("AA") registered alloys such as the 1XXX, 2XXX, 3XXX, 4XXX, 5XXX, 6XXX, 7XXX, and 8XXX series alloys as well as any Master Alloys. In one embodiment, the molten aluminum alloy comprises 5XXX and/or 7XXX series alloys. In another embodiment, the molten aluminum alloy comprises 7050 and/or 5083 series alloys.

As used herein, the term "atmosphere" includes gases such as air, helium, argon, nitrogen, carbon dioxide, carbon monoxide, products of combustion of natural gas or fuel oil, methane, ethane, propane, natural gas, organic fluorine compounds, organic chlorine compounds, chlorine, sulfur hexafluoride and organic fluoro-chloro compounds. As used herein, the term "humidified atmosphere" includes an atmosphere in which the water content has been intentionally increased and/or purposefully added. In normal casting operations, the atmosphere contacting the surface of the molten alloy is depleted of any moisture due to the high temperature of the atmosphere present above the alloy surface. In order to contact the surface of the molten alloy with a humidified atmosphere, water must be purposefully added to the atmosphere to maintain an effective humidity level. As used herein, the term "effective humidity" means a level of humidity as defined by the present invention sufficient to limit the formation of surface oxide on the molten aluminum alloy.

The term "contacting" the surface of the molten aluminum alloy with a humidified atmosphere means that a humidified atmosphere is intentionally introduced to the surface of the molten aluminum, e.g., into the vessel into which the molten aluminum alloy is cast. Preferably, the humidified atmosphere is introduced near the surface of the molten alloy by such methods as pressurized steam, spraying, misting, bubbling gas through an aqueous body, vaporizing and the like.

Figure 7:
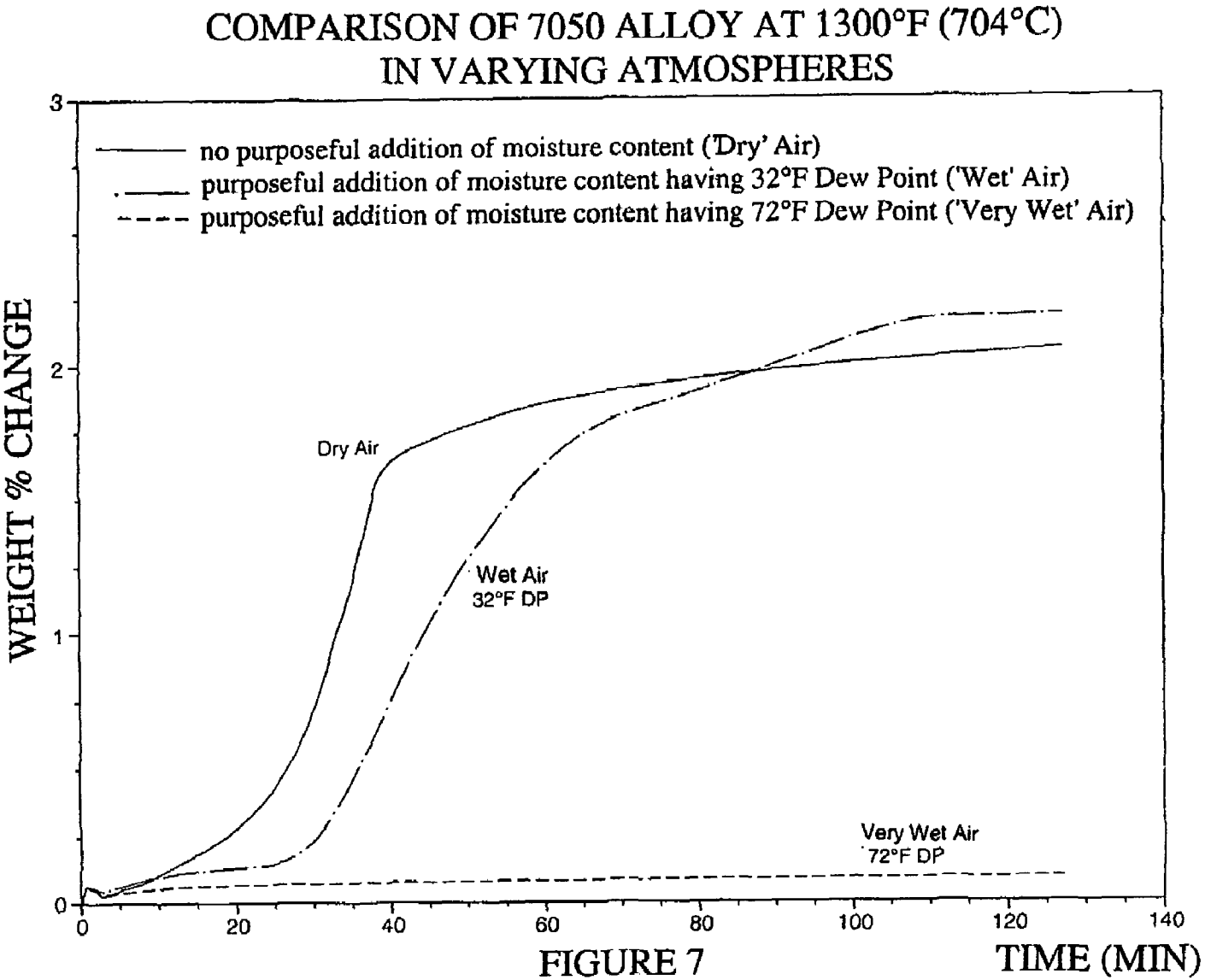
FIG. 7 is a graph showing the wt. % change over time for a 7050 alloy cast at 1,300° F. (7041 ° C.) in atmospheres having a moisture content of about 0.02 kg/m$^3$, a moisture content of about 0.005 kg/m$^3$, and a casting atmosphere with no purposeful addition of moisture content.

It is contemplated herein that there are several ways of controlling the moisture content of the humidified air. For example, when the atmosphere is bubbled through an aqueous body above a critical flow rate, the moisture content of the atmosphere is decreased. As used herein, the term "critical flow rate" means any condition in which an amount of unit aqueous body per gas is less than saturated. Furthermore, when the atmosphere is held at a cooler temperature, the corresponding dew point cannot hold as much water content and therefore results in a less humid humidified atmosphere. In accordance with an embodiment of the present invention, the humidified atmosphere contacts the surface of the molten alloy with a sufficient moisture content to produce a reduced oxide thickness. The humidified atmosphere may comprise air having a casting atmosphere moisture content of from about 0.009 $kg/m^3$ to about 0.17 $kg/m^3$ (from about 0.0006 $lb/ft^3$ to about 0.01 $lb/ft^3$.) The humidified atmosphere preferably comprises air having a casting atmosphere moisture content of from about 0.01 $kg/m^3$ to about 0.06 $kg/m^3$ (from about 0.001 $lb/ft^3$ to about 0.004 $lb/ft^3$.) FIG. 7 illustrates the weight percent gain of oxide for 7050 alloy cast in dry air, air having a humidified atmosphere of about 0.005 $kg/m^3$ corresponding to a 32° F. (0° C.) dew point, and air having a humidified atmosphere of about 0.02 $kg/m^3$ corresponding to a 72° F. (22° C.) dew point. It is herein contemplated that the humidified atmosphere may be adjusted using various factors, such as reducing or increasing the pressure above the surface of the molten alloy, to obtain a moisture content suitable for obtaining an oxide surface layer of desired thickness.

Figure 20:
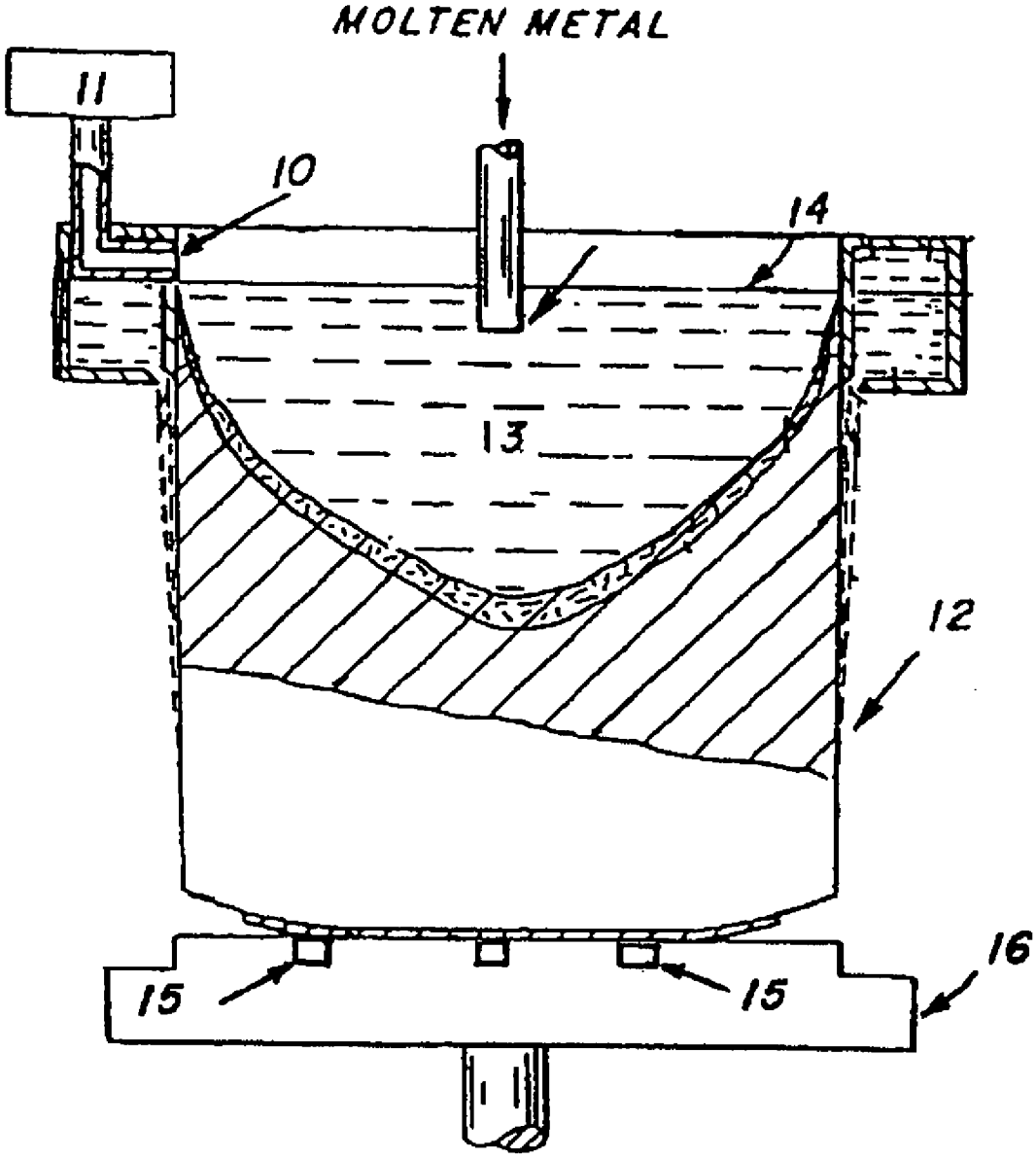
FIG. 20 is a drawing of a continuous casting vessel including a humidified gas injector near the surface of the molten alloy in accordance with one embodiment of the present invention.

The introduction of a humidified atmosphere into a conventional casting apparatus may be accomplished with very few modifications. For example, FIG. 20 shows a humidified atmosphere injector 10, connected to a source of humidified atmosphere 11. The humidified atmosphere injector 10 is in flow communication with a conventional casting vessel 12, containing a molten alloy 13. The injector 10 is positioned above the surface of the molten alloy 14, in order to allow the humidified atmosphere to contact the surface of the molten alloy 13. Safety liquid water sensors 15 prevent the introduction of the humidified atmosphere 11 into the casting vessel 12 before the molten alloy 13 is present in the casting system. In one embodiment, the safety liquid water sensors 15 are located adjacent to, or contained within, bottom block 16. Safety liquid water sensors 15 require that the entire surface of the mold is contacted with the molten alloy prior to the introduction of the humidified atmosphere into the casting system in order to prevent the possibility of explosion. When molten alloy is deposited in a mold that contains liquid water, the temperature of the molten alloy causes the water to vaporize rapidly thereby causing the water to undergo a phase change and form steam. This phase change results in over a 1,000-times change in volume. The steam trapped under the molten alloy increases pressure in the mold, and can produce finely divided air borne aluminum which can cause an explosion. In order to properly introduce moisture into the casting system, precautionary measures, such as safety liquid water sensors 15, must be in place to ensure safe operation. Although a direct chill (DC) casting system is shown in FIG. 20, the method of this invention is suitable for use with other conventional casting systems.

The introduction of the humidified atmosphere preferably occurs in close proximity to the molten alloy surface. The humidified atmosphere may be introduced into the casting system at a stage when the molten alloy is in the form of a quiescent pool. Alternatively, the humidified atmosphere and the molten alloy may be introduced into the casting system simultaneously. However, if water is present on the surface(s) of the molten aluminum alloy containment vessel when the molten aluminum alloy is introduced into the casting system, there is a high risk of an aluminum explosion caused by the phase change of liquid water into steam as the alloy is introduced into the casting system. In order to avoid these dangerous conditions, in one embodiment safety liquid water sensors may be present in the casting system to ensure that the humidified atmosphere is not introduced until the molten aluminum alloy is present in the casting system. In another embodiment, the bottom block may be heated to temperatures of about 212° F. (100° C.) or higher to ensure that no liquid water is present in the casting vessel 12 prior to the introduction of the molten aluminum alloy.

Although the phase change of liquid water to steam is dangerous when water is located between the casting vessel and the molten aluminum alloy, there is no danger of explosion when the humidified atmosphere contacts the surface of the molten alloy that is exposed to the air and not in contact with liquid water on the casting vessel surfaces.

In accordance with the present invention, the molten aluminum alloy may be solidified by conventional cooling methods including contacting the molten aluminum with water, organics, water and organic mixtures, fluorocarbon compounds, gas cooled metallic chill blocks or rings, graphite chill blocks or rings with or without casting lubricant at the solidifying meniscus of the molten aluminum. In one embodiment, the humidified atmosphere contacts the surface of the molten aluminum alloy from the time the molten aluminum is introduced into the casting apparatus until the molten aluminum solidifies. In another embodiment, the humidified atmosphere contacts the surface of the molten aluminum alloy at the time the molten alloy is first being introduced into the casting apparatus until the aluminum alloy solidifies to the extent that it forms a shell having a thickness sufficient to prevent breakthrough egresses of molten alloy. In a further embodiment, the molten aluminum alloy is continuously supplied to an open-ended mold and the surface of the molten aluminum alloy is contacted with the humidified atmosphere substantially throughout the entire casting and ingot extraction process.

The cast aluminum alloy may be optionally worked. Working may include hot rolling, cold rolling, extruding, forging, drawing, ironing, aging, forming, stretching and other techniques known to those skilled in the art.

The method of the present invention is particularly effective in improving surface properties, such as surface brightness and reduced surface cracking, in alloys comprising at least about 0.1 wt. % magnesium. Sample alloys that can exhibit enhanced properties pursuant to this invention include 5XXX and 7XXX series, for example 7050 and 5083 alloys. The aluminum-magnesium alloys may optionally comprise up to 50 wt. % Mg, and more preferably comprises less than about 12 wt. % Mg. The aluminum-magnesium alloys may further contain alkaline earth metals, transition metals, rare earth metals and/or other alloying additions which provide desired properties.

An improved aluminum-magnesium cast alloy of the present invention may comprise, for example, at least about 0.1 wt. % Mg, up to about 50 wt. % Mg, and have a surface oxide layer comprising magnesium oxide, magnesium hydroxide, magnesium oxy/hydroxide, and/or aluminum oxy/hydroxide and other alloying elements having a thickness of less than about 8,000 angstroms. More preferably, the surface oxide has a thickness of less than about 5,000 angstroms. Carbon and magnesium carbonate may also be integrated into the oxide layer depending on the composition of the atmosphere during oxide formation.

Figure 6:
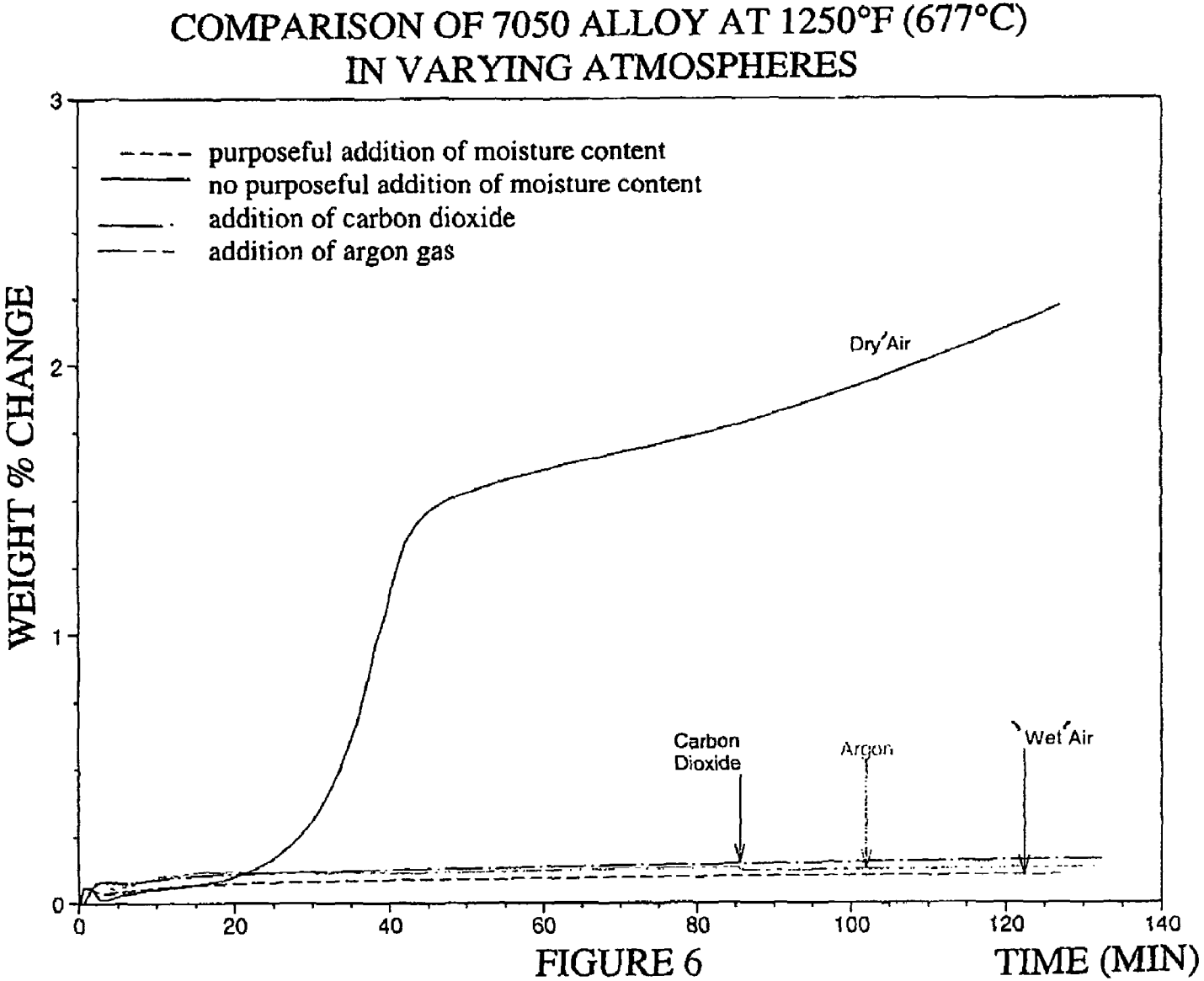
FIG. 6 is a graph showing the wt. % change over time for a 7050 alloy cast at 1,250° F. (677° C.) in atmospheres having a purposeful addition of moisture, no purposeful addition of moisture, comprising carbon dioxide gas, and comprising argon gas.

Alloys cast by the method of this invention exhibit improved surface oxide properties when compared to conventionally cast alloys, and exhibit comparably thin surface oxide layers when compared to alloys cast in a pure argon atmosphere, which is expensive, or a carbon dioxide atmosphere, which poses additional environmental concerns. As illustrated by FIG. 6, alloys cast by the method of the present invention exhibit comparable wt. % gain of oxide, but do not encounter the problems associated with casting in argon or carbon dioxide atmospheres.

Variations to the dew point of the humidified atmosphere further vary the wt. % gain of surface oxide. As illustrated by FIG. 7, alloys cast by the method of the present invention exhibit less surface oxide gain when the molten alloy is contacted with a humidified atmosphere having a 72° F. (22° C.) dew point than when the molten alloy is contacted with a humidified atmosphere having a 32° F. (0° C.) dew point.

EXAMPLE 1

An alloy having improved surface oxide properties is produced in accordance with the present invention as follows. A 7050 alloy is machined to a 0.125-inch thickness. A 5/32-inch diameter punch is then used to obtain a cylindrical sample of the 7050 alloy. A small sample press is used on the cylinder to flatten the slightly deformed ends resulting from the punch. Using a TA Instruments 2950 Thermogravimetric Analyzer (TGA), tare the sample holder, which consists of a standard platinum pan and a low-walled, 0.25-inch I.D. alumina pan. The 7050 alloy cylinder is then centered inside the alumina pan, such that only the bottom of the sample contacts the holder. A TGA temperature program is equilibrated at 1,250° F. (677° C.) and the 7050 alloy sample is held isothermally at 1250° F. (677° C.) for two hours. During this time, air is bubbled through a water source to produce a humidified atmosphere having a moisture content of about 0.02 kg/m$^3$ corresponding to about a 72° F. (22° C.) dew point. The humidified atmosphere contacts the 7050 alloy sample at a temperature of 1,250° F. (677° C.) for a period of two hours to adequately simulate casting conditions. The sample is then allowed to return to room temperature. A second test was carried out on another 7050 alloy sample using the same procedure except that it was subjected to a dry atmosphere having no purposeful addition of moisture content. The 7050 alloy sample subjected to the humidified atmosphere gained significantly less oxide than the 7050 sample that was subjected to the dry atmosphere. The wt. % change of both samples is graphed together in FIG. 1.

EXAMPLE 2

Figure 2:
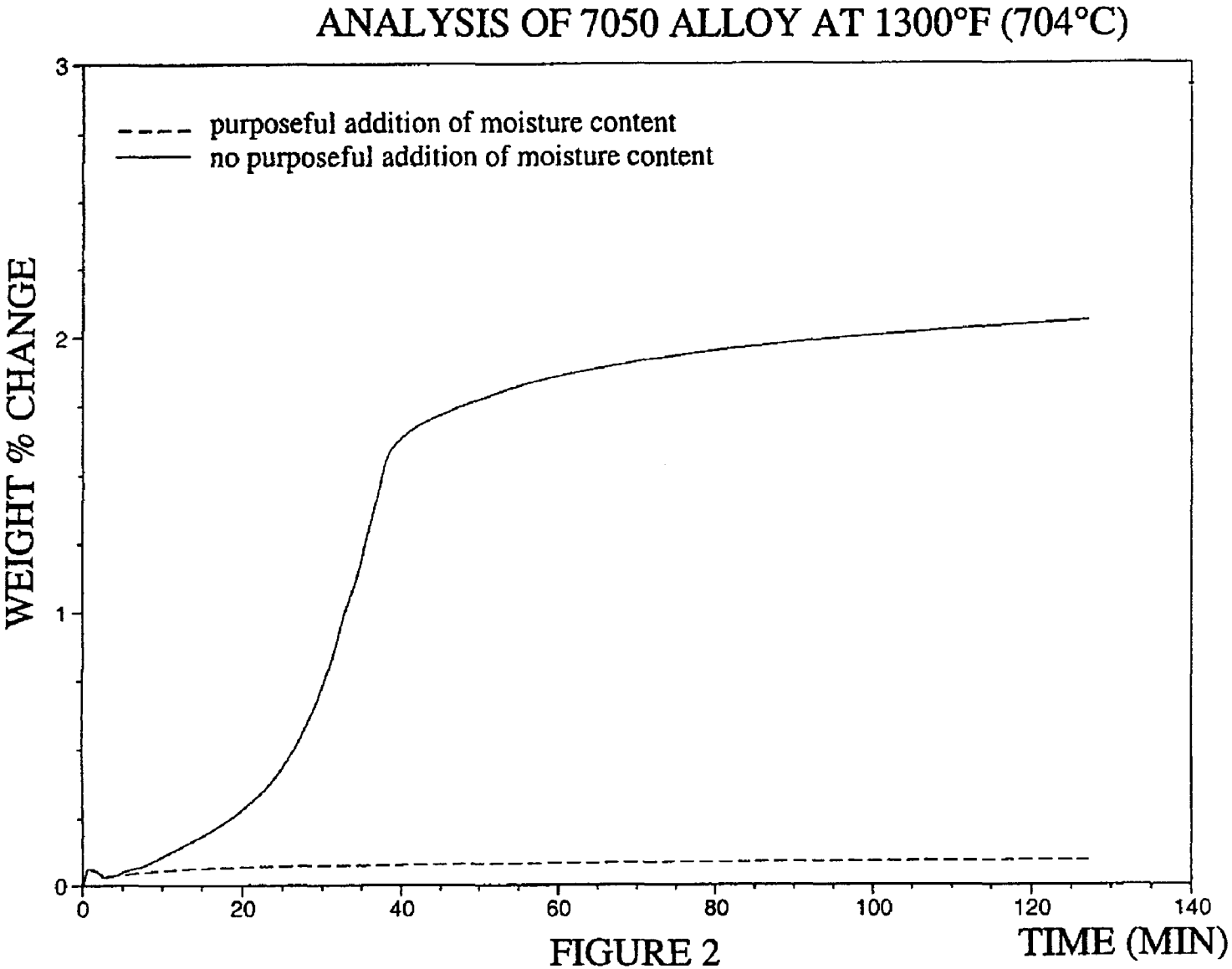
FIG. 2 is a graph showing the wt. % change over time for a 7050 alloy cast at 1,300° F. (7041 ° C.) in atmospheres having a purposeful addition of moisture content and no purposeful addition of moisture content.

Example 1 was repeated except that both 7050 alloy samples are held isothermally at 1,300° F. (7041 ° C.) for two hours. The 7050 alloy sample subjected to the humidified atmosphere gained significantly less oxide than the 7050 sample that was subjected to the dry atmosphere. The wt. % change of both samples is graphed together in FIG. 2.

EXAMPLE 3

Figure 3:
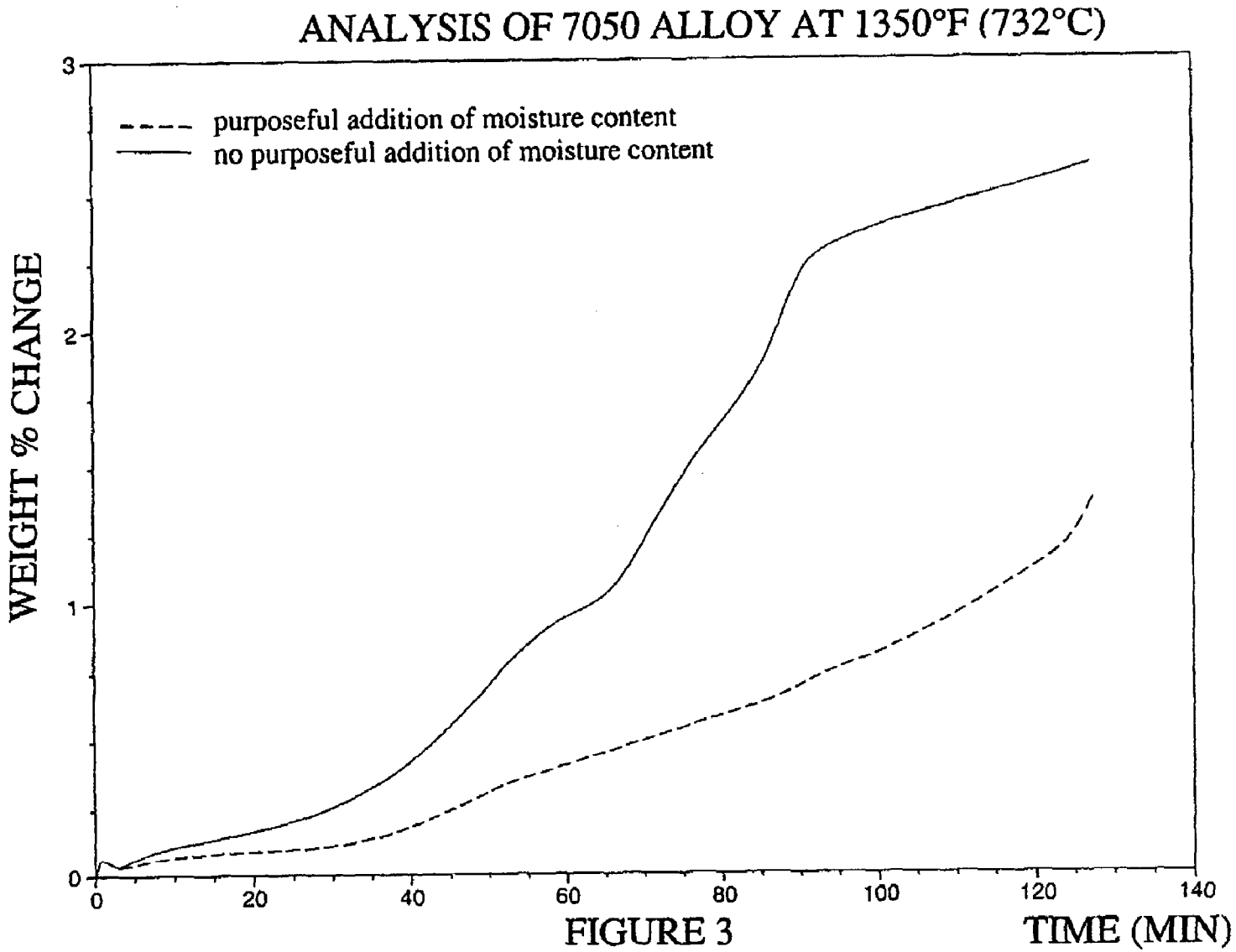
FIG. 3 is a graph showing the wt. % change over time for a 7050 alloy cast at 1,350° F. (732° C.) in atmospheres having a purposeful addition of moisture content and no purposeful addition of moisture content.

Example 1 was repeated except that both 7050 alloy samples are held isothermally at 1,350° F. (732° C.) for two hours. The 7050 alloy sample subjected to the humidified atmosphere gained significantly less oxide than the 7050 sample that was subjected to the dry atmosphere. The wt. % change of both samples is graphed together in FIG. 3.

EXAMPLE 4

Figure 4:
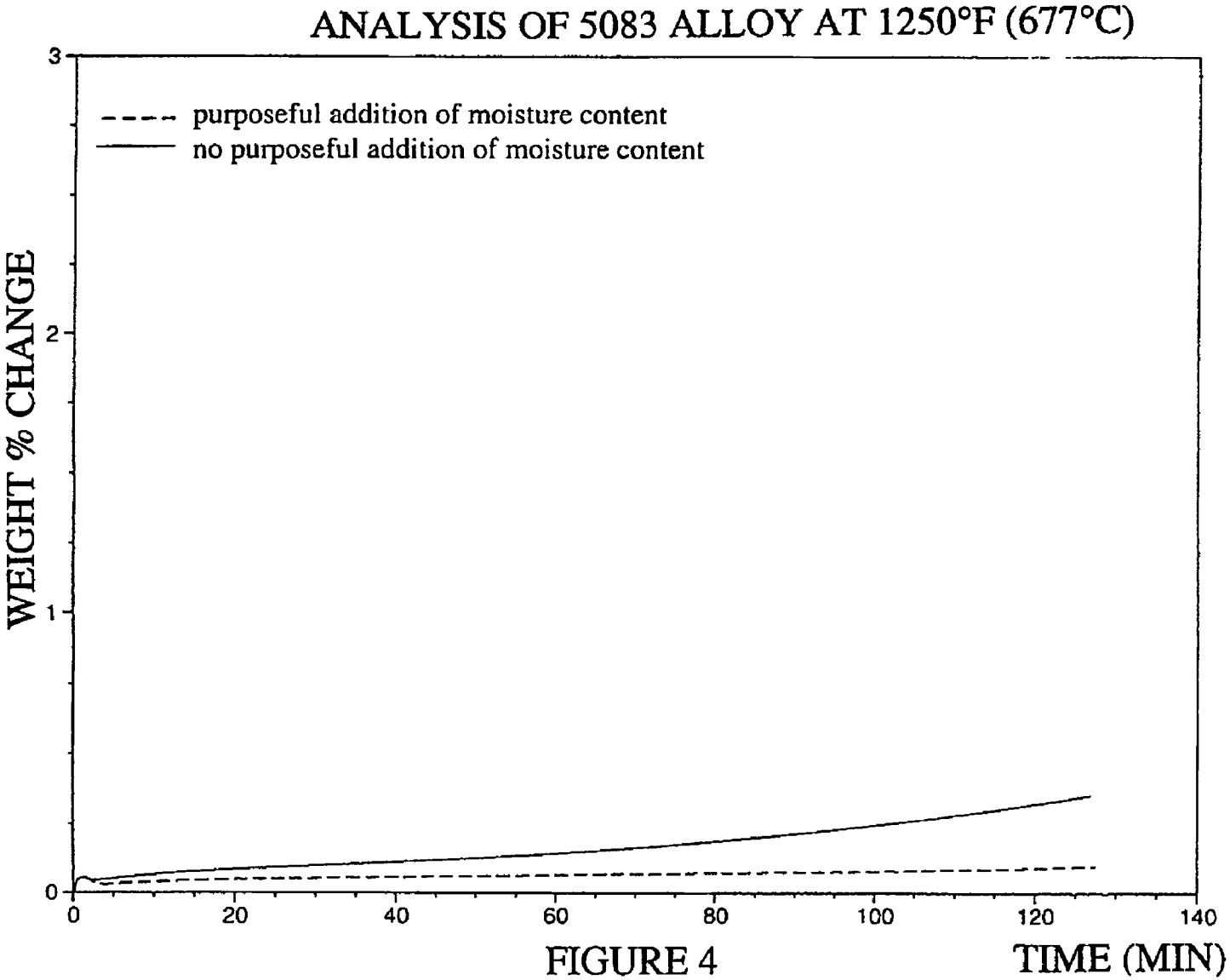
FIG. 4 is a graph showing the wt. % change over time for a 5083 alloy cast at 1,250° F. (677° C.) in atmospheres having a purposeful addition of moisture content and no purposeful addition of moisture content.

Example 1 was repeated except that samples of 5083 alloy samples are prepared and analyzed. The 5083 alloy sample subjected to the humidified atmosphere gained significantly less oxide than the 5083 sample that was subjected to the dry atmosphere. The wt. % change of both samples is graphed together in FIG. 4.

EXAMPLE 5

Figure 5:
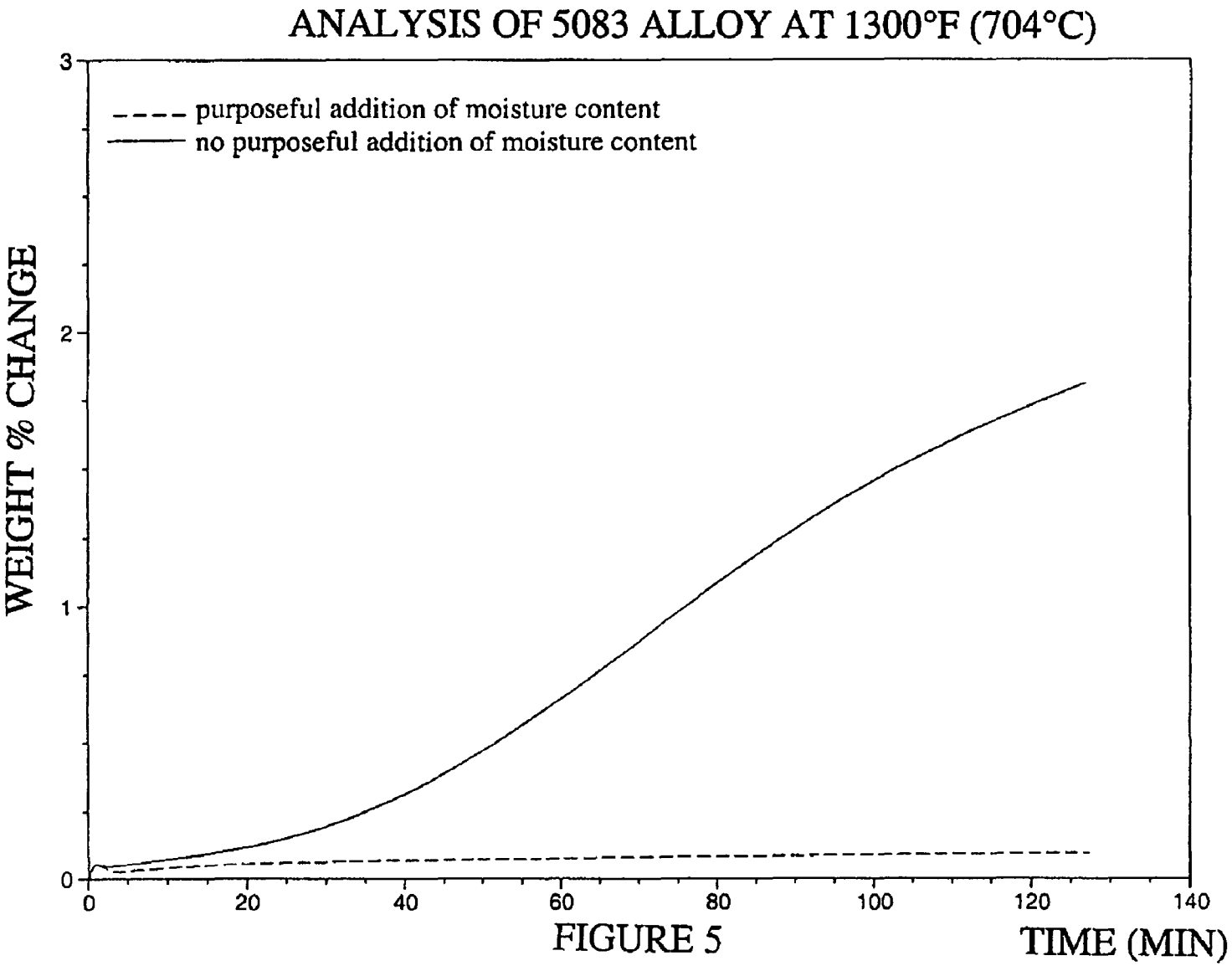
FIG. 5 is a graph showing the wt. % change over time for a 5083 alloy cast at 1,300° F. (7041 ° C.) in atmospheres having a purposeful addition of moisture content and no purposeful addition of moisture content.

Example 1 was repeated except that samples of 5083 alloy are prepared and held isothermally at 1,300° F. (7041 ° C.) for two hours. The 5083 alloy sample subjected to the humidified atmosphere gained significantly less oxide than the 5083 sample that was subjected to the dry atmosphere. The wt. % change of both samples is graphed together in FIG. 5.

Figure 8:
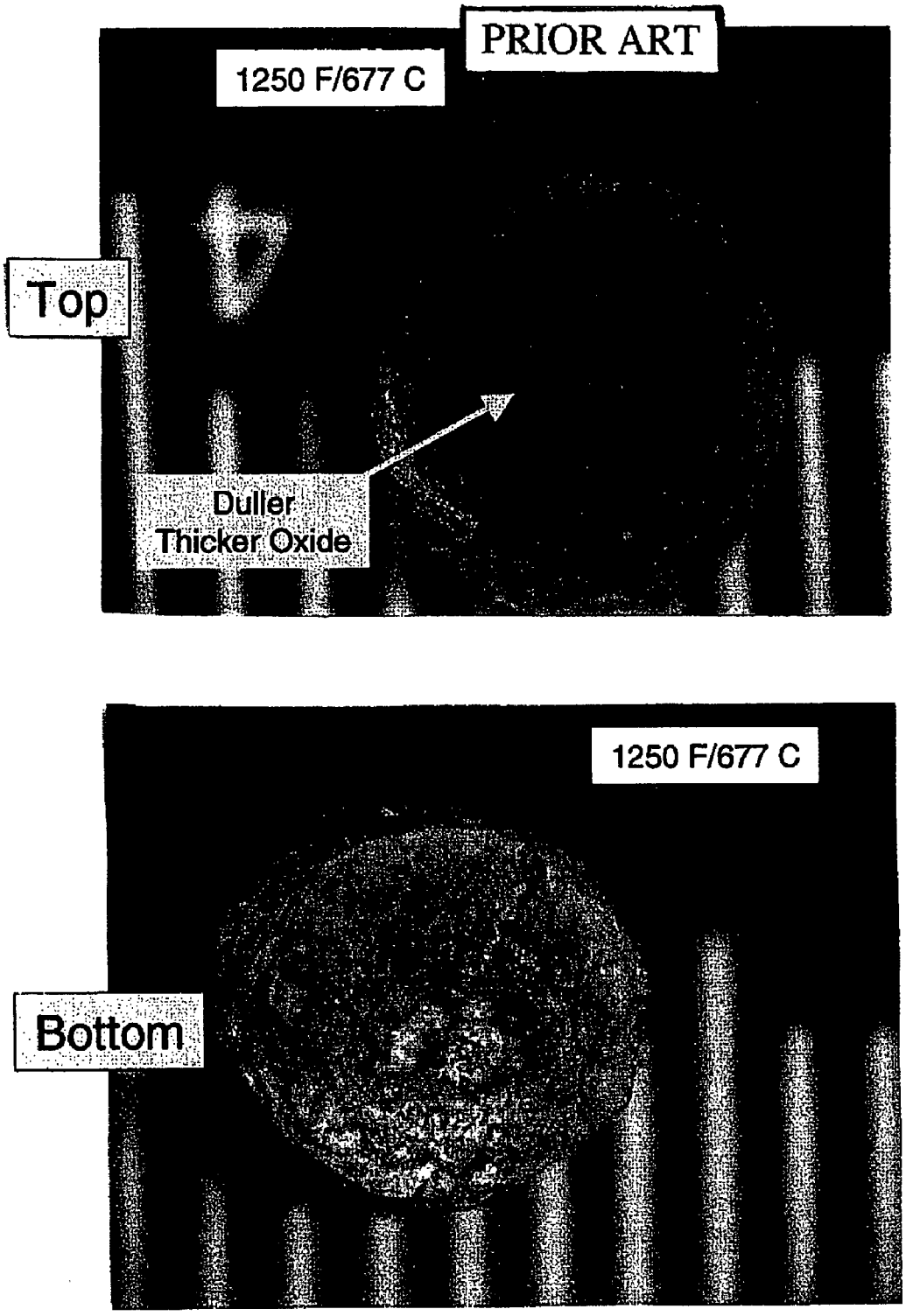
FIG. 8 is a micrograph showing the top surface and the bottom surface of an aluminum-magnesium alloy sample subjected to prior art casting conditions at 1,250° F. (677° C.).
Figure 9:
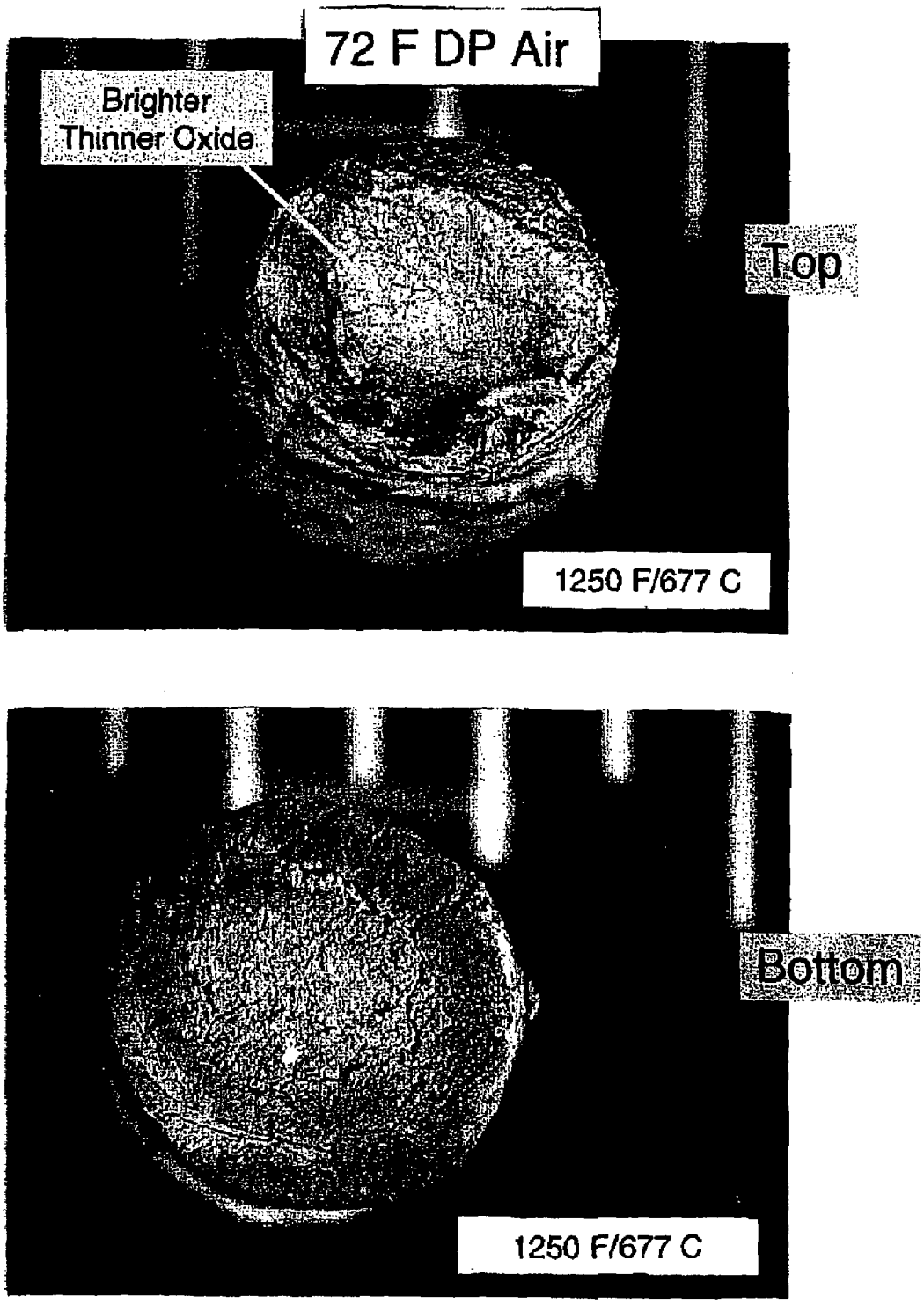
FIG. 9 is a micrograph showing the top surface and the bottom surface of an aluminum-magnesium alloy sample subjected to the casting conditions of the present invention at 1,250° F. (677° C.).

FIG. 8 illustrates the duller thicker oxide that forms on the surface of an aluminum-magnesium alloy when subjected to traditional prior art casting conditions at 1,250° F. (677° C.). In contrast, FIG. 9 shows the brighter thinner oxide that forms on the surface of an aluminum-magnesium alloy when subjected to the casting conditions of the present invention at 1,250° F. (677° C.).

Figure 10:
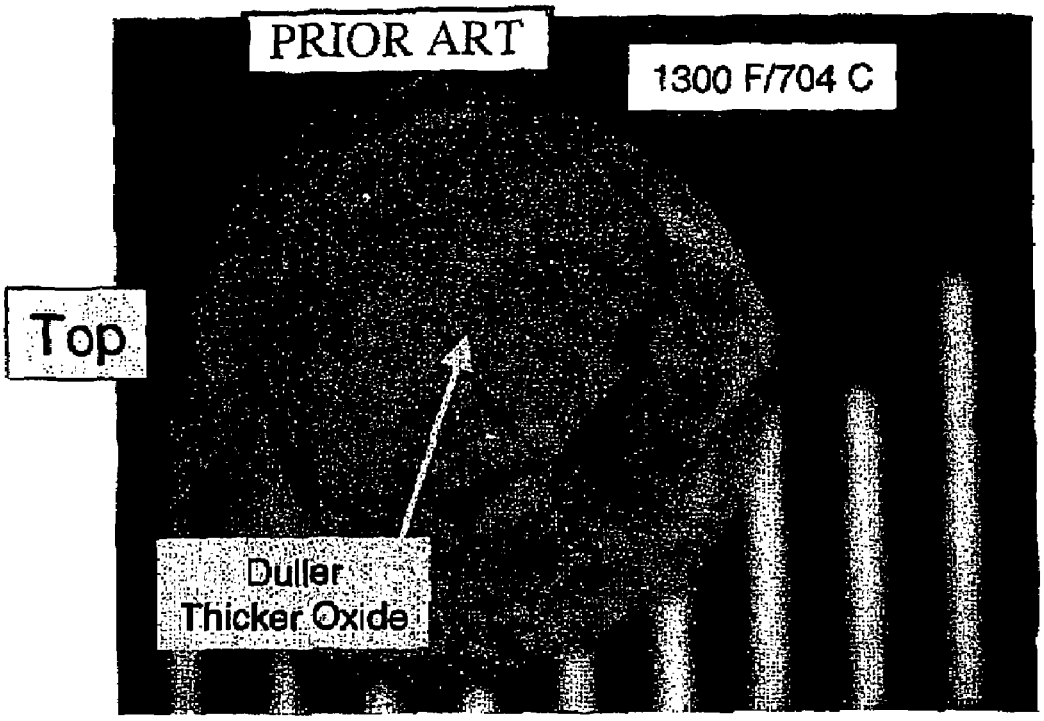
FIG. 10 is a micrograph showing the top surface and the bottom surface of an aluminum-magnesium alloy sample subjected to prior art casting conditions at 1,300° F. (7041 ° C.).
Figure 10:
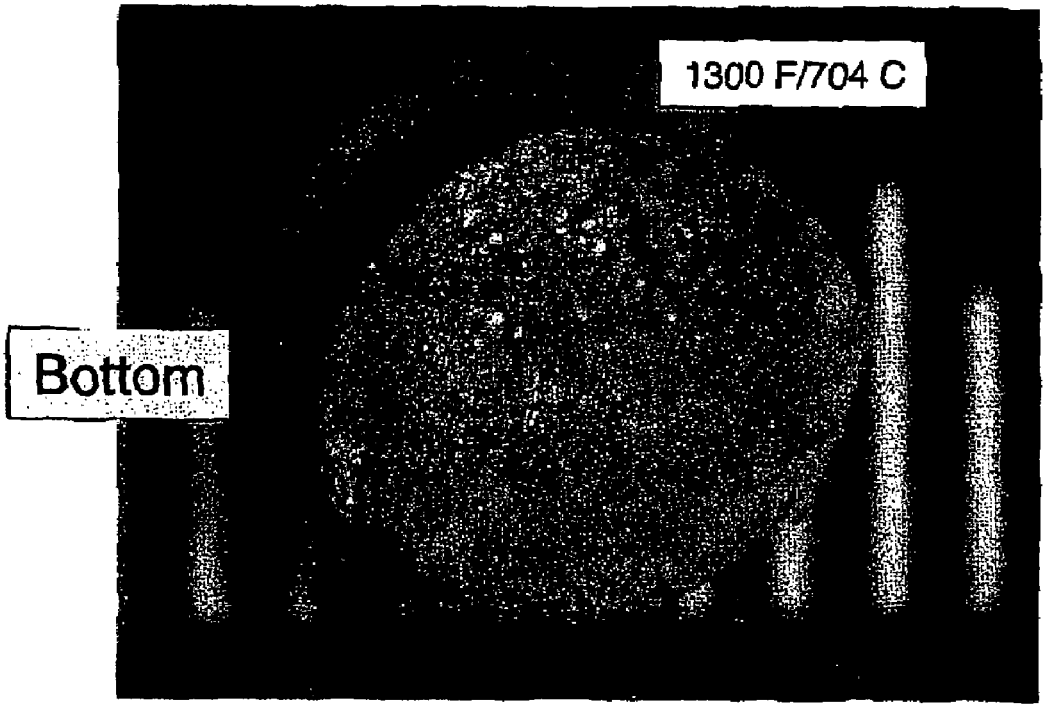
Figure 11:
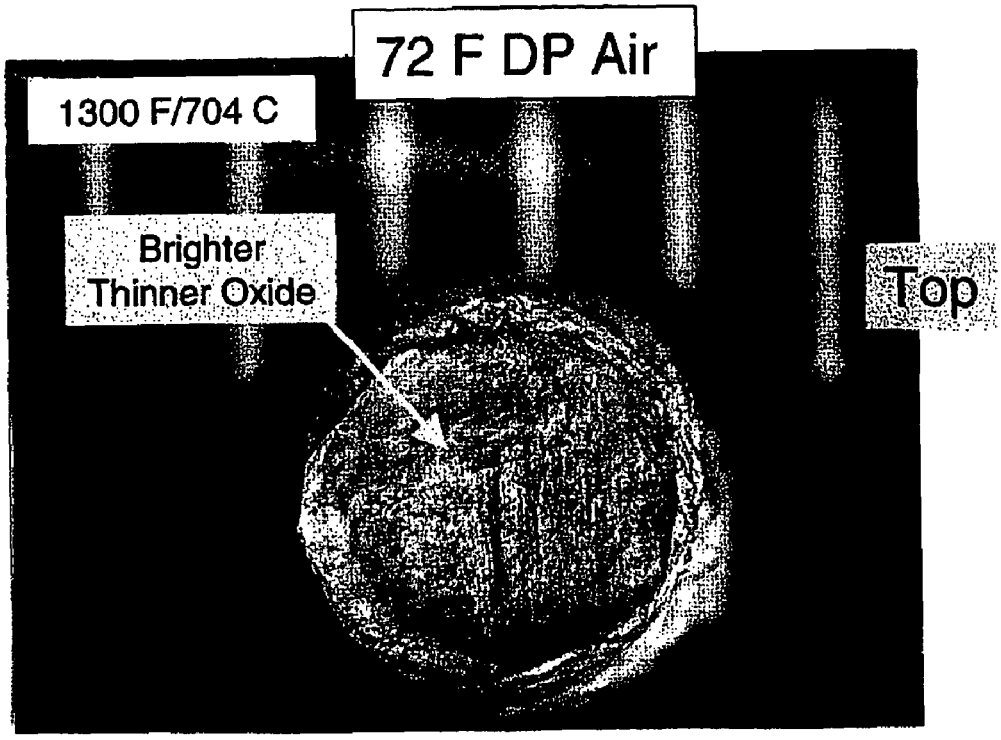
FIG. 11 is a micrograph showing the top surface and the bottom surface of an aluminum-magnesium alloy sample subjected to the casting conditions of the present invention at 1,300° F. (7041 ° C.).
Figure 11:
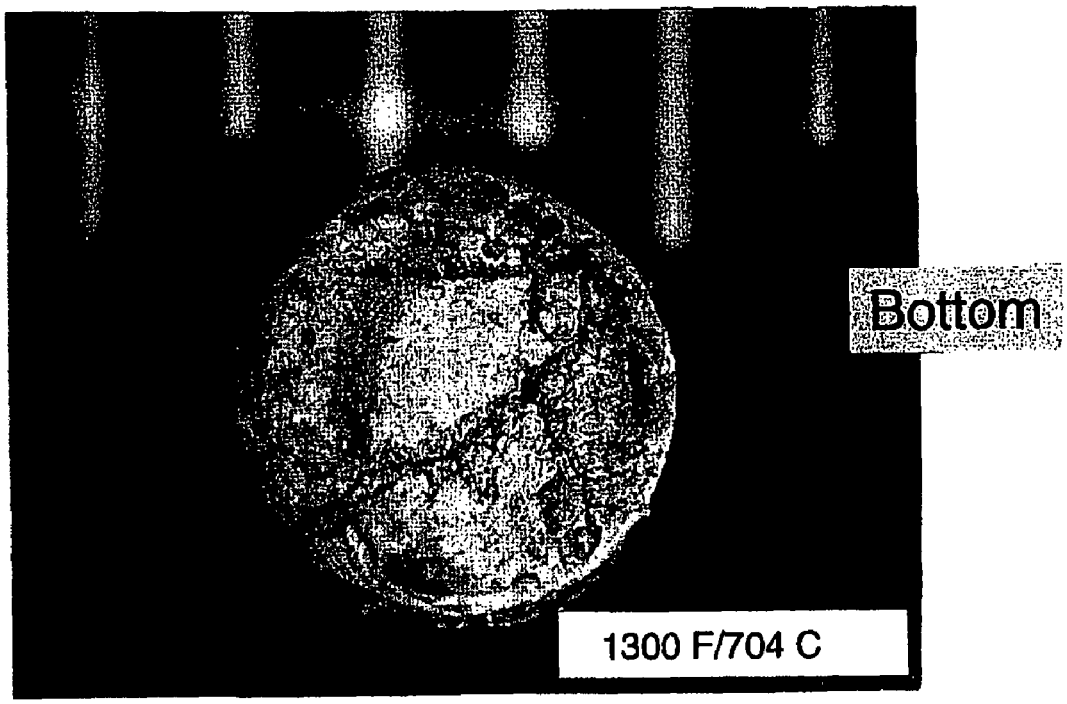

FIG. 10 illustrates the duller thicker oxide that forms on the surface of an aluminum-magnesium alloy when subjected to traditional prior art casting conditions at 1,300° F. (7041 ° C.). In contrast, FIG. 11 shows the brighter thinner oxide that forms on the surface of an aluminum-magnesium alloy when subjected to the casting conditions of the present invention at 1,300° F. (7041 ° C.).

Figure 12:
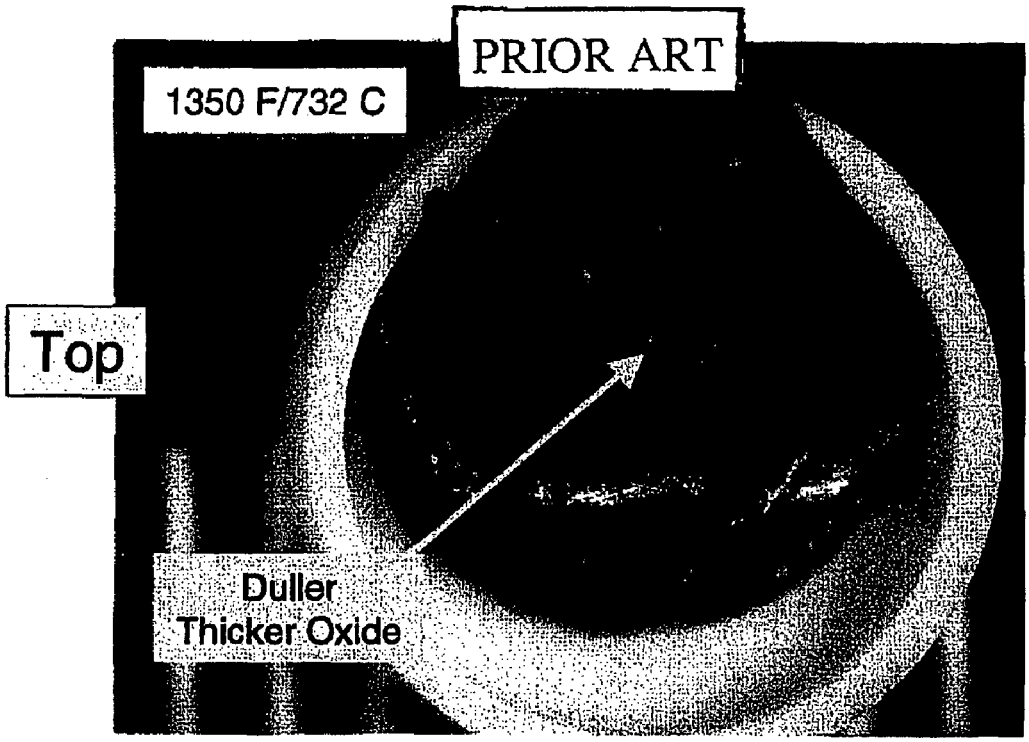
FIG. 12 is a micrograph showing the top surface of an aluminum-magnesium alloy sample subjected to prior art casting conditions at 1,350° F. (732° C.).
Figure 13:
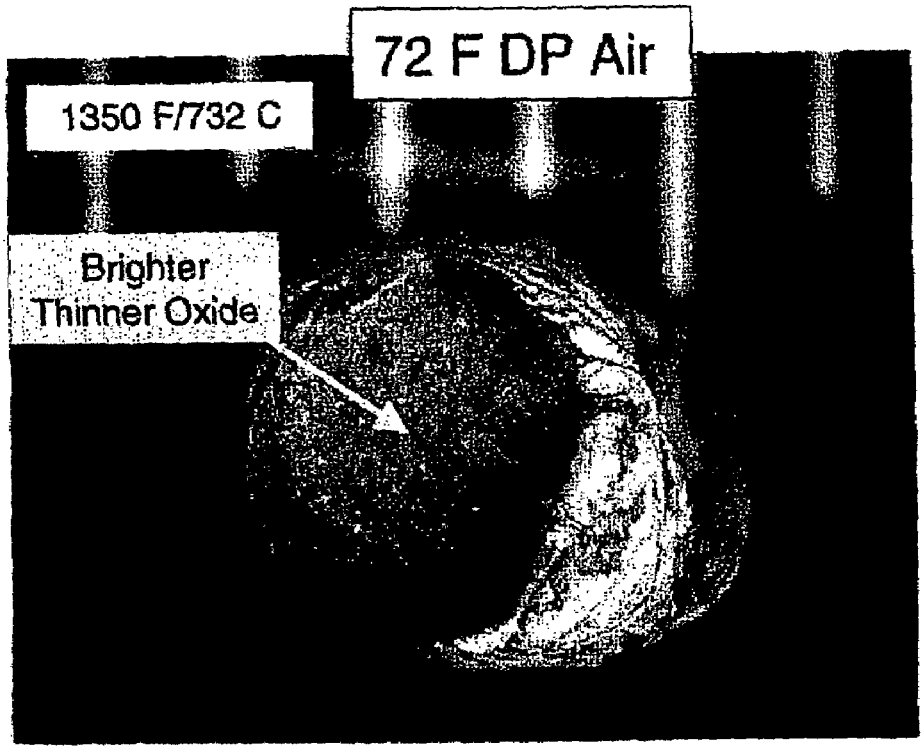
FIG. 13 is a micrograph showing the top surface and the bottom surface of an aluminum-magnesium alloy sample subjected to the casting conditions of the present invention at 1,350° F. (732° C.).
Figure 13:
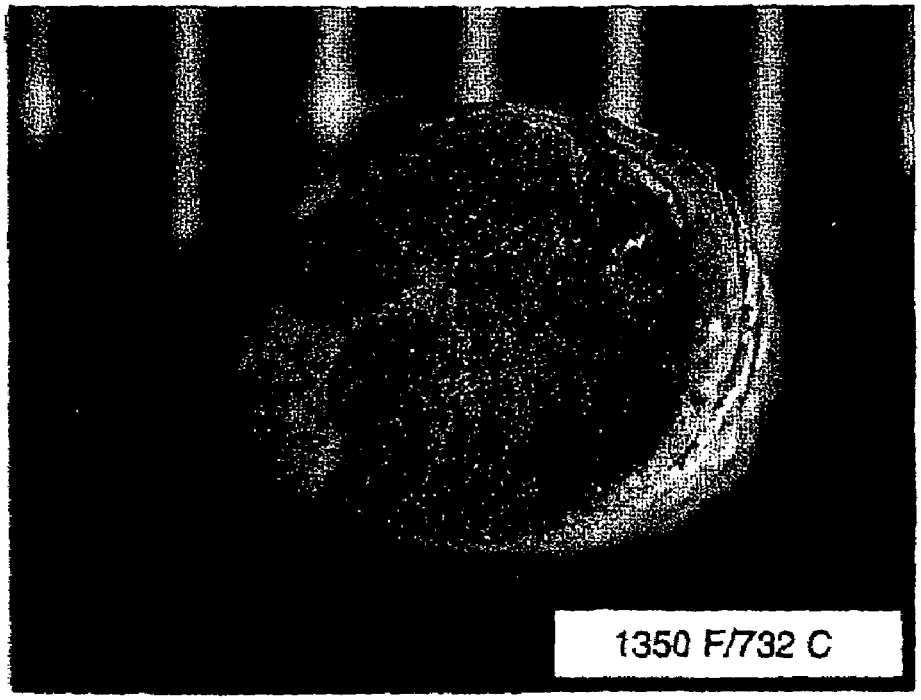

FIG. 12 illustrates the duller thicker oxide that forms on the surface of an aluminum-magnesium alloy when subjected to traditional prior art casting conditions at 1,350° F. (732° C.). In contrast, FIG. 13 shows the brighter thinner oxide that forms on the surface of an aluminum-magnesium alloy when subjected to the casting conditions of the present invention at 1,350° F. (732° C.).

Figure 14:
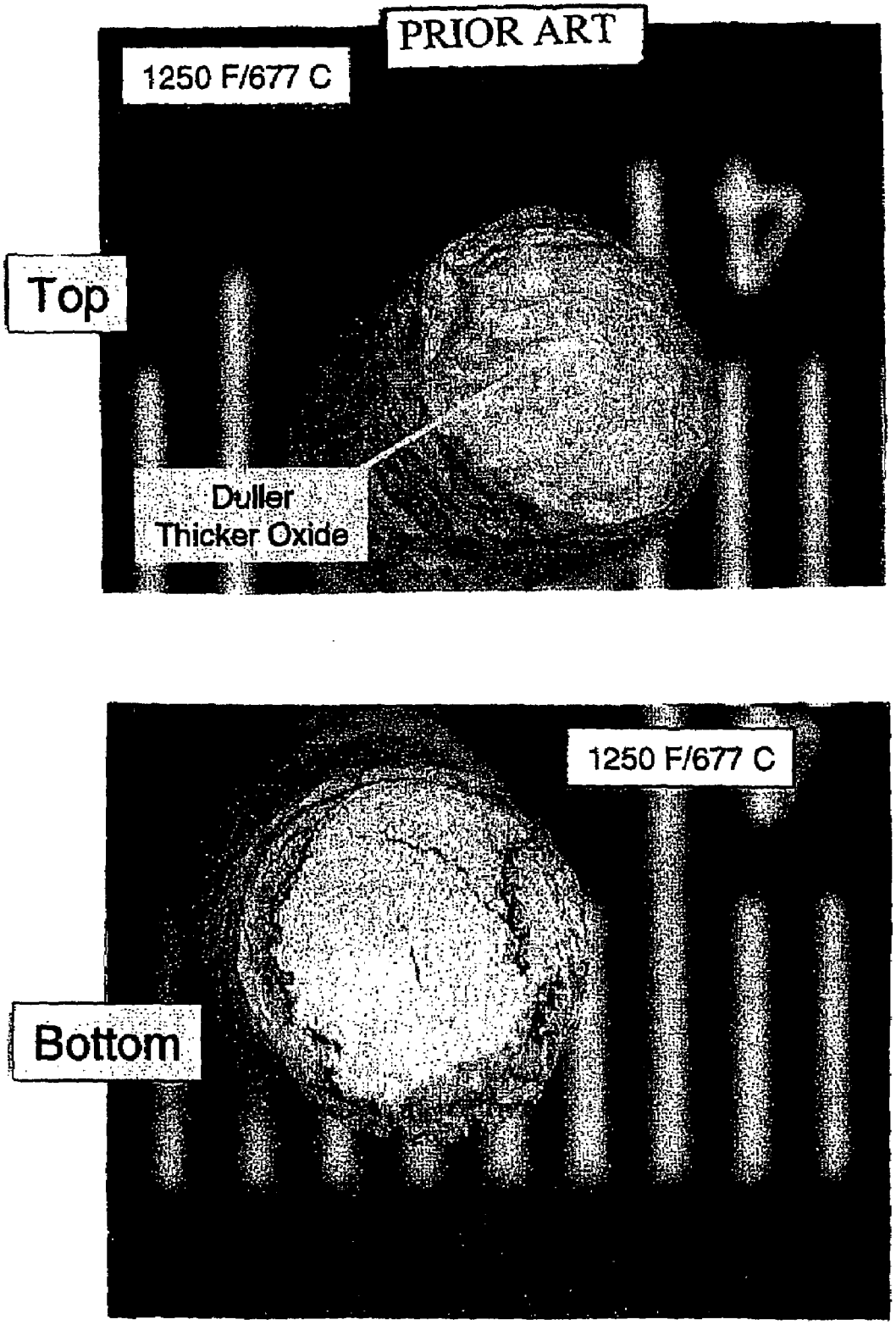
FIG. 14 is a micrograph showing the top surface and the bottom surface of an aluminum-magnesium alloy sample containing 13 ppm beryllium and 6 ppm calcium subjected to prior art casting conditions at 1,250° F. (677° C.).
Figure 15:
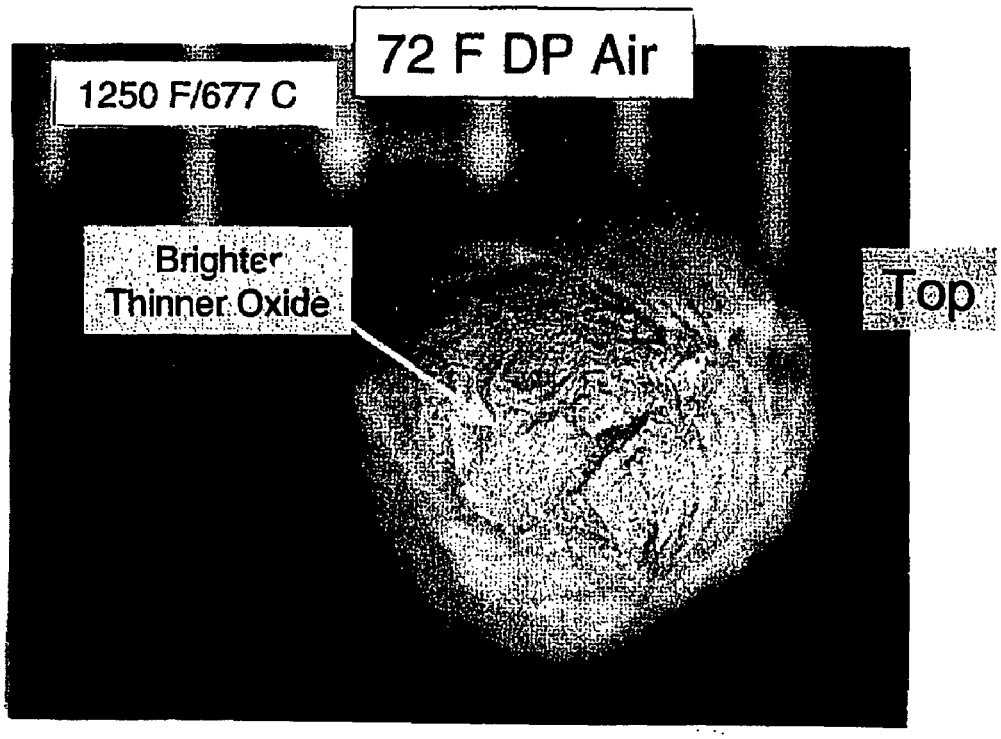
FIG. 15 is a micrograph showing the top surface and the bottom surface of an aluminum-magnesium alloy sample containing 13 ppm beryllium and 6 ppm calcium subjected to the casting conditions of the present invention at 1,250° F. (677° C.).
Figure 15:
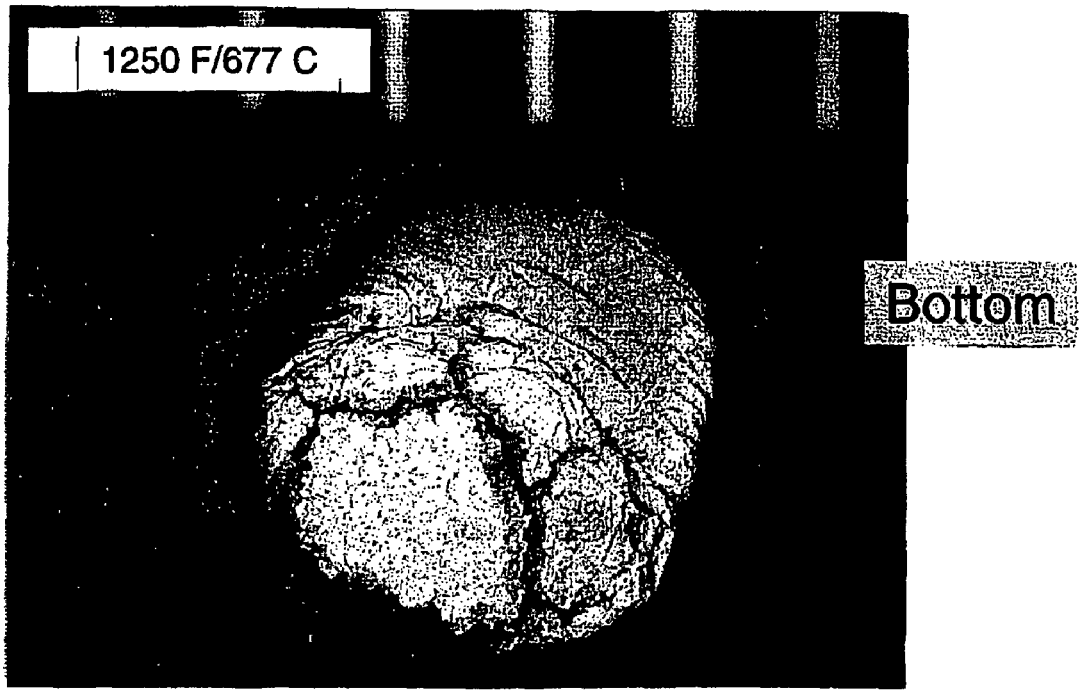

FIG. 14 illustrates the duller thicker oxide that forms on the surface of an aluminum-magnesium alloy containing 13 ppm beryllium and 6 ppm calcium when subjected to traditional prior art casting conditions at 1,250° F. (677° C.). In contrast, FIG. 15 shows the brighter thinner oxide that forms on the surface of an aluminum-magnesium alloy containing 13 ppm beryllium and 6 ppm calcium when subjected to the casting conditions of the present invention at 1,250° F. (677° C.).

Figure 16:
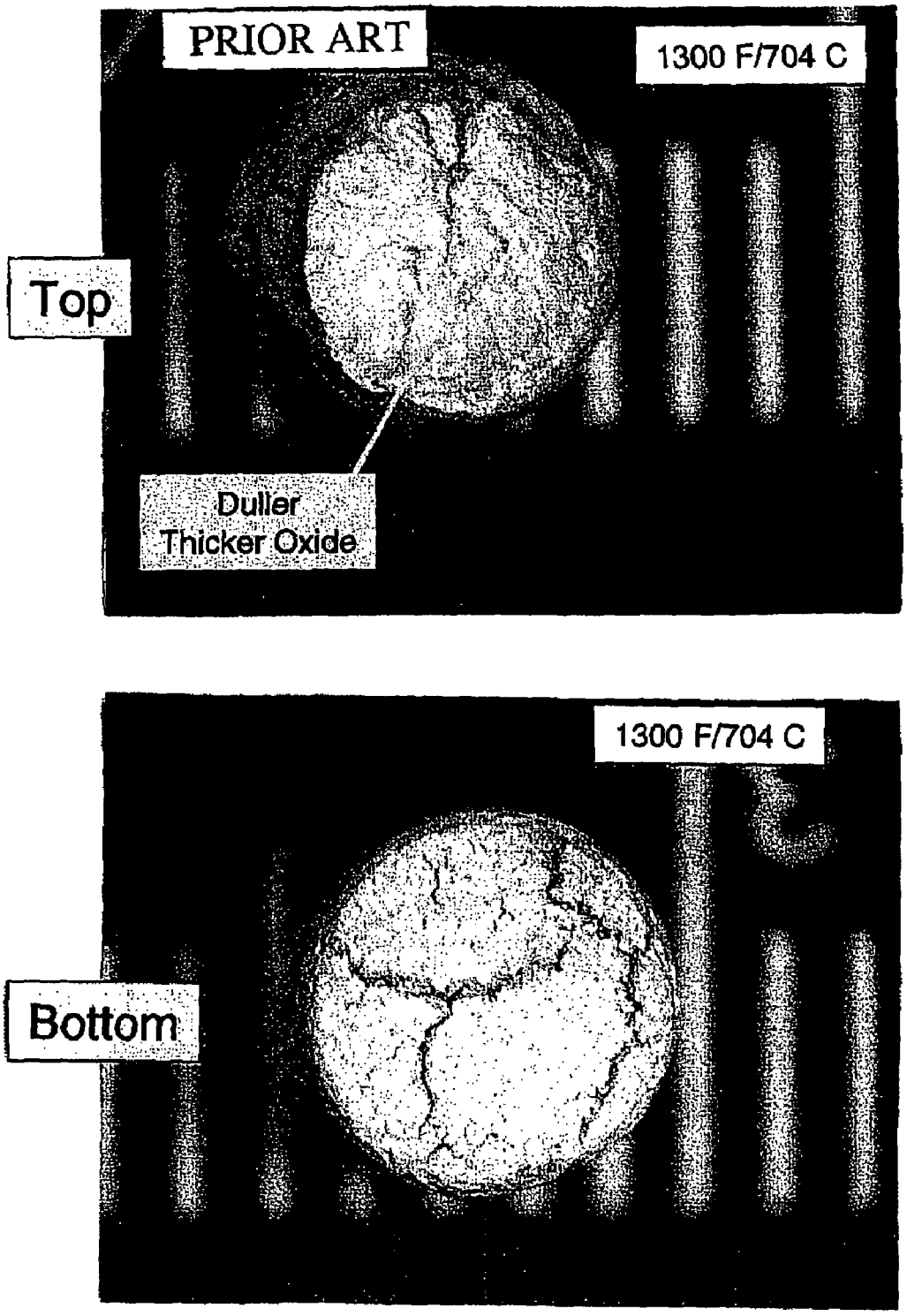
FIG. 16 is a micrograph showing the top surface and the bottom surface of an aluminum-magnesium alloy sample containing 13 ppm beryllium and 6 ppm calcium subjected to prior art casting conditions at 1,300° F. (7041 ° C.).
Figure 17:
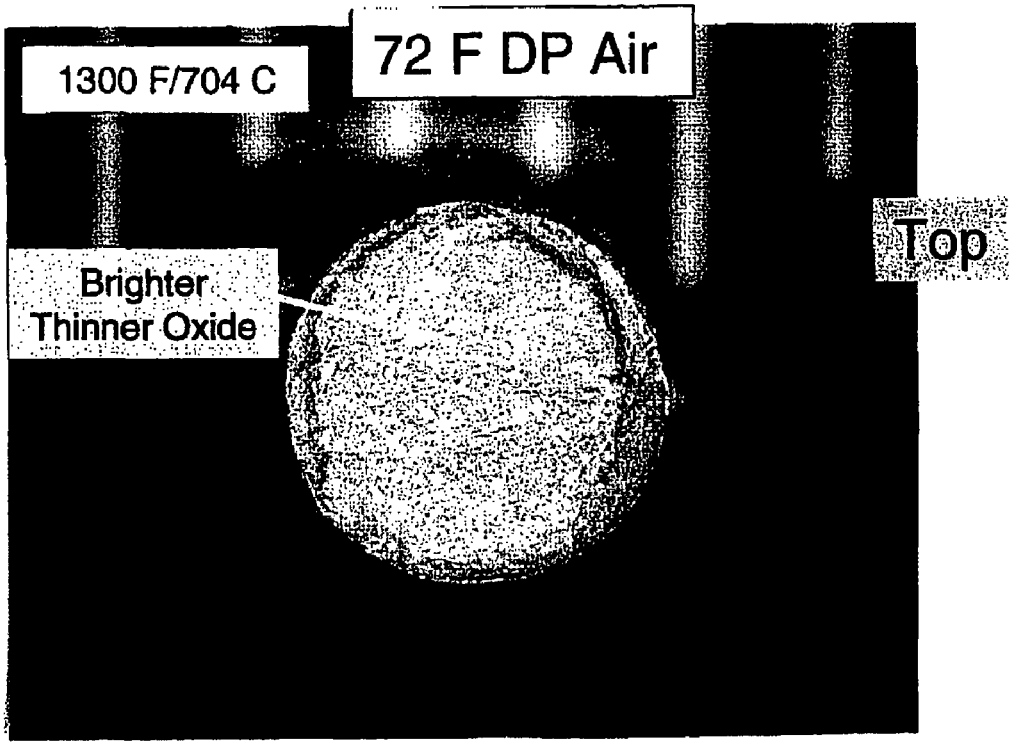
FIG. 17 is a micrograph showing the top surface and the bottom surface of an aluminum-magnesium alloy sample containing 13 ppm beryllium and 6 ppm calcium subjected to the casting conditions of the present invention at 1,300° F. (7041 ° C.).
Figure 17:
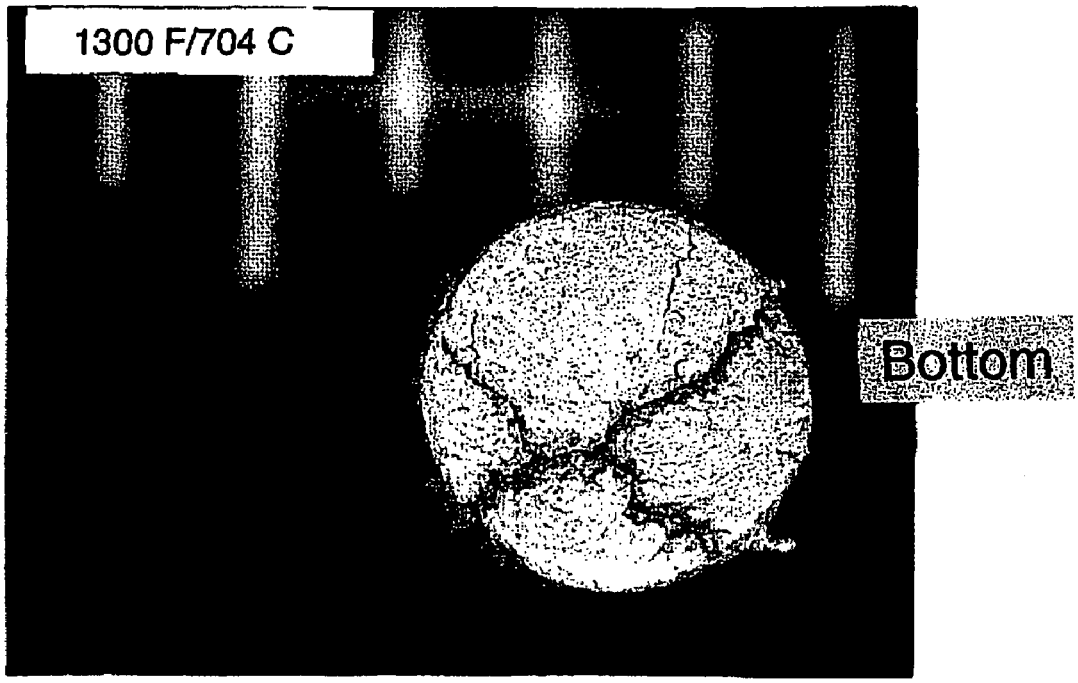

FIG. 16 illustrates the duller thicker oxide that forms on the surface of an aluminum-magnesium alloy containing 13 ppm beryllium and 6 ppm calcium when subjected to traditional prior art casting conditions at 1,300° F. (7041 ° C.). In contrast, FIG. 17 shows the brighter thinner oxide that forms on the surface of an aluminum-magnesium alloy containing 13 ppm beryllium and 6 ppm calcium when subjected to the casting conditions of the present invention at 1,300° F. (7041 ° C.).

Figure 18:
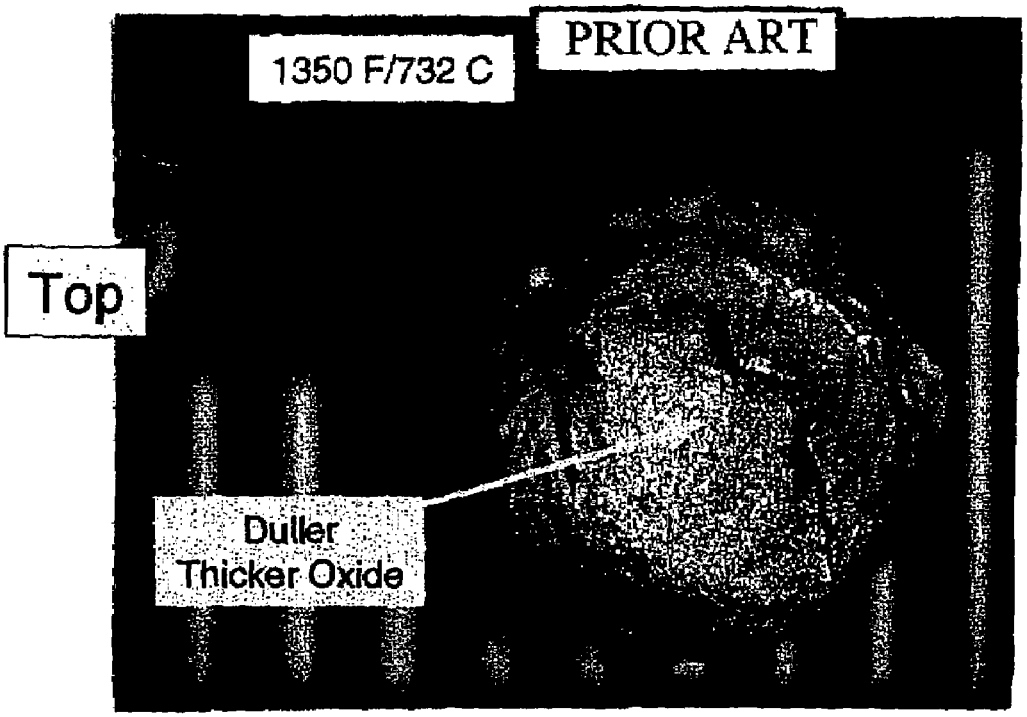
FIG. 18 is a micrograph showing the top surface and the bottom surface of an aluminum-magnesium alloy sample containing 13 ppm beryllium and 6 ppm calcium subjected to prior art casting conditions at 1,350° F. (732° C.).
Figure 18:
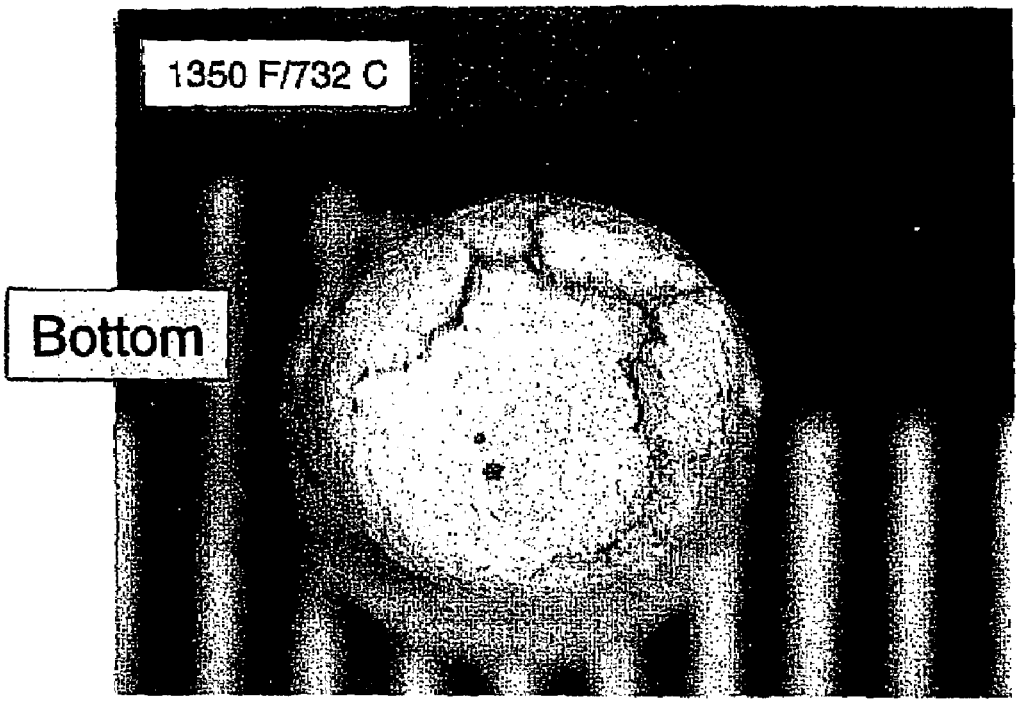
Figure 19:
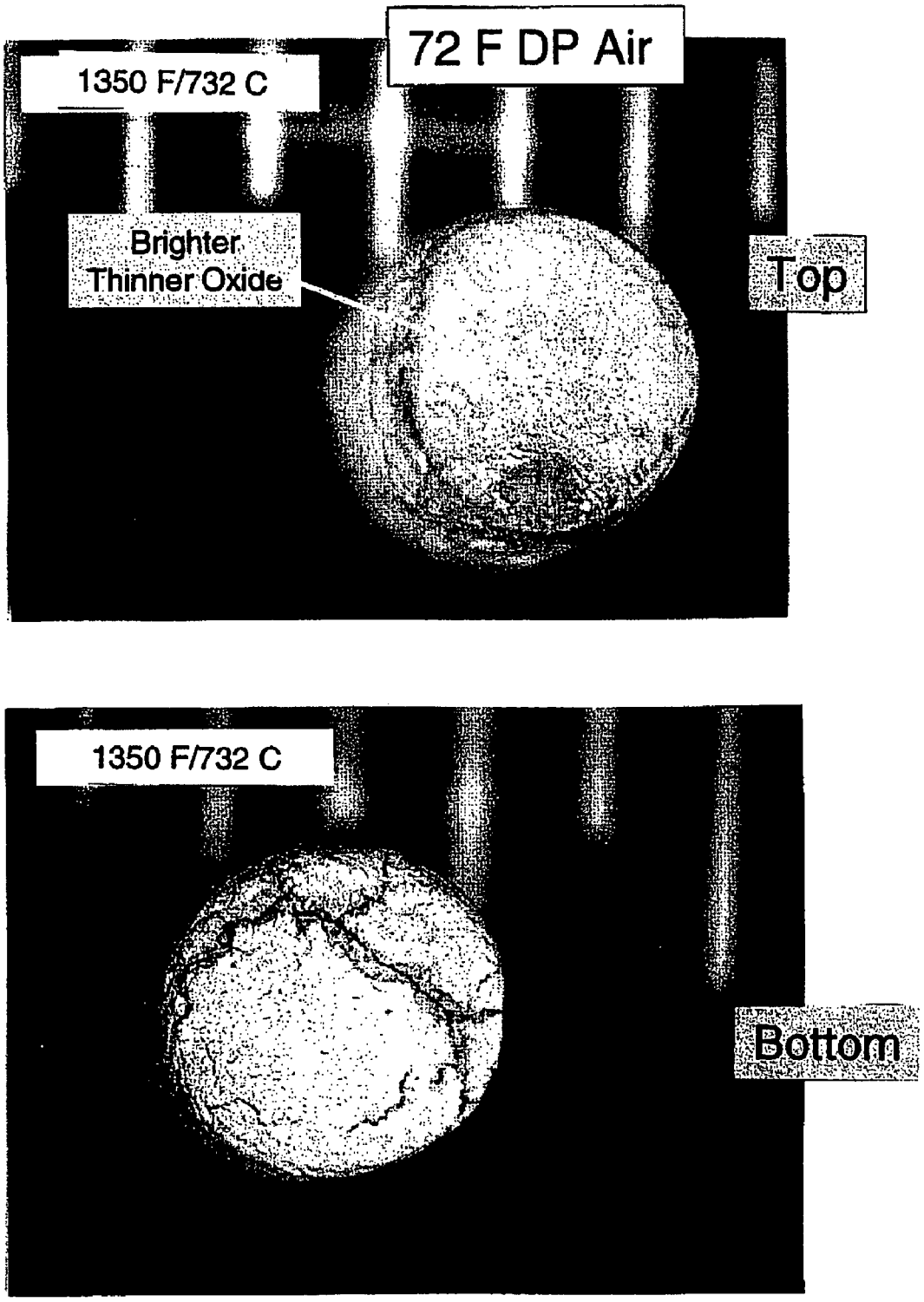
FIG. 19 is a micrograph showing the top surface and the bottom surface of an aluminum-magnesium alloy sample containing 13 ppm beryllium and 6 ppm calcium subjected to the casting conditions of the present invention at 1,350° F. (732° C.).

FIG. 18 illustrates the duller thicker oxide that forms on the surface of an aluminum-magnesium alloy containing 13 ppm beryllium and 6 ppm calcium when subjected to traditional prior art casting conditions at 1,350° F. (732° C.). In contrast, FIG. 19 shows the brighter thinner oxide that forms on the surface of an aluminum-magnesium alloy containing 13 ppm beryllium and 6 ppm calcium when subjected to the casting conditions of the present invention at 1,350° F. (732° C.).

What is claimed is:

1. A continuous casting method of improving surface properties of cast aluminum alloys comprising: providing a molten aluminum alloy; humidifying a gas to a predetermined moisture content to form a humidified atmosphere; introducing the humidified atmosphere near a surface of the molten aluminum alloy; and substantially maintaining the predetermined moisture content of the humidified atmosphere near the surface during solidification phase of the molten aluminum alloy.

2. The method of claim 1 wherein the surface of the molten aluminum alloy is subjected to the humidified atmosphere by forcing a humidified gas over the surface of the molten aluminum alloy.

3. The method of claim 2 wherein the humidified gas comprises at least one of: air, helium, argon, nitrogen, carbon dioxide, carbon monoxide, products of combustion of natural gas or fuel oil, methane, ethane, propane, natural gas, organic fluorine compounds, organic chlorine compounds and organic fluoro-chloro compounds.

4. The method of claim 1 wherein the molten aluminum alloy is solidified by a casting method.

5. The method of claim 1 wherein the aluminum alloy comprises at least about 0.1 wt. % magnesium.

6. The method of claim 1 wherein the aluminum alloy comprises at least about 0.2 wt. % magnesium.

7. The method of claim 1 wherein the aluminum alloy comprises at least about 0.3 wt. % magnesium.

8. The method of claim 1 wherein the aluminum alloy is a 1XXX, 2XXX, 3XXX, 4XXX, 5XXX, 6XXX, 7XXX or 8XXX series wrought alloy.

9. The method of claim 8 wherein the aluminum alloy is selected from the group of 7050, 7055, 7085, 7150 and 7075.

10. The method of claim 8 wherein the aluminum alloy is a 5182, 5086, 5454, 5052 and 5083.

11. The method of claim 1 wherein the aluminum alloy is a 100, 200, 300, 400, 500, 600, 700 or 800 series cast alloy.

12. The method of claim 1 wherein the aluminum alloy comprises up to about 50 wt. % Mg.

13. The method of claim 1 wherein the solidified molten aluminum alloy is provided in the form of an ingot.

14. The method of claim 13 further comprising working the ingot.

15. The method of claim 13 wherein working the ingot comprises at least one of: hot rolling, cold rolling, extruding, forging, drawing, ironing, aging, forming and stretching.

16. The method of claim 1 wherein the predetermined moisture content ranges from about 0.009 $kg/m^3$ to about 0.2 $kg/m^3$.

17. The method of claim 1 wherein the predetermined moisture content ranges from about 0.01 $kg/m^3$ to about 0.07 $kg/m^3$.

18. A method of improving surface properties of cast aluminum alloys comprising: providing a molten aluminum alloy; humidifying a gas to a predetermined moisture content to form a humidified atmosphere; introducing the humidified atmosphere near a surface of the molten aluminum alloy; and substantially maintaining the predetermined moisture content of the humidified atmosphere near the surface during solidification phase of the molten aluminum alloy, wherein the predetermined moisture content ranges from about 0.009 $kg/m^3$ to about 0.2 $kg/m^3$.

19. The method of claim 18 wherein the casting method comprises direct chill casting, electromagnetic casting, horizontal direct chili casting, hot top casting, continuous casting, semi-continuous casting, belt casting, die casting, roll casting, slab casting, sand casting, centrifugal casting, lost foam casting, permanent mold casting, plaster casting, pressure die casting and/or vacuum casting.

20. The method of claim 19 wherein the casting method is employed at a temperature of between about the solidus temperature of the alloy and about 300° F. (149° C.) above the liquidus temperature of the alloy.

21. The method of claim 19 wherein the casting method is employed at a temperature of between about 50° F. (10° C.) above the liquidus temperature of the alloy and about 200° F. (93° C.) above the liquidus temperature of the alloy.

22. A method of improving surface properties of cast aluminum alloys comprising: providing a molten aluminum alloy; humidifying a gas to a predetermined moisture content to form a humidified atmosphere; introducing the humidified atmosphere near a surface of the molten aluminum alloy; and substantially maintaining the predetermined moisture content of the humidified atmosphere near the surface during solidification phase of the molten aluminum alloy, wherein the moisture content ranges from about 0.01 $kg/m^3$ to about 0.07 $kg/m^3$.

23. A continuous casting method for limiting the growth of surface oxide on aluminum-magnesium alloys comprising: providing a molten aluminum alloy having at least 0.1 wt. % magnesium; contacting a surface of the molten aluminum with a humidified atmosphere having a moisture content above about 0.005 kg/m$^3$; and solidifying the molten aluminum alloy.

24. The method of claim 23 wherein the humid atmosphere has a moisture content of from about 0.009 kg/m$^3$ to about 0.2 kg/m$^3$.

25. The method of claim 23 wherein the humid atmosphere has a moisture content of from about 0.01 kg/m$^3$ to about 0.07 kg/m$^3$.

26. A method for limiting the growth of surface oxide aluminum-magnesium alloys comprising: providing a molten aluminum alloy having at least 0.1 wt. % magnesium; contacting a surface of the molten aluminum with a humidified atmosphere having a moisture content of from about 0.009 kg/m$^3$ to about 0.2 kg/m$^3$; and solidifying the molten aluminum alloy.

27. A method for limiting the growth of surface oxide on aluminum-magnesium alloys comprising: providing a molten aluminum alloy having at least 0.1 wt. % magnesium; contacting a surface of the molten aluminum with a humidified atmosphere having a moisture content of from about 0.01 kg/m$^3$ to about 0.07 kg/m$^3$; and solidifying the molten aluminum alloy.

28. A continuous casting method of improving surface properties of cast aluminum alloys comprising: providing a molten aluminum alloy humidifying a gas to a predetermined moisture content to form a humidified atmosphere; introducing the humidified atmosphere near a surface of the molten aluminum alloy; and substantially maintaining the predetermined moisture content of the humidified atmosphere near the surface during solidification phase of the molten aluminum alloy, wherein the humidified atmosphere contacts the surface of the molten aluminum alloy from at least a time the molten aluminum alloy is introduced to a casting apparatus to at least a time when the molten aluminum alloy forms a surface oxide layer having a thickness sufficient to prevent breakthrough egress of the molten aluminum alloy.

* * * * *

UNITED STATES PATENT AND TRADEMARK OFFICE

CERTIFICATE OF CORRECTION

PATENT NO. : 7,267,158 B2 
APPLICATION NO. : 10/612866
DATED : September 11, 2007
INVENTOR(S) : Paula L. Kolek et al.

It is certified that error appears in the above-identified patent and that said Letters Patent is hereby corrected as shown below:

In column 1, line 58, after the second occurrence of "the", delete "casing" and insert --casting--.

In column 2, line 46, after "1,300°F.," delete "(7041 ° C)" and insert --(704°C)--.
In column 2, line 58, after "1,300°F.," delete "(7041 ° C)" and insert --(704°C)--.
In column 2, line 67, after "1,300°F.," delete "(7041 ° C)" and insert --(704°C)--.
In column 3, lines 14-15, after "1,300°F.," delete "(7041 ° C)" and insert --(704°C)--.
In column 3, line 19, after "1,300°F.," delete "(7041 ° C)" and insert --(704°C)--.
In column 3, line 39, after "1,300°F.," delete "(7041 ° C)" and insert --(704°C)--.
In column 3, line 44, after "1,300°F.," delete "(7041 ° C)" and insert --(704°C)--.
In column 8, line 31, after "1,300°F.," delete "(7041 ° C)" and insert --(704°C)--.
In column 8, line 58, after "1,300°F.," delete "(7041 ° C)" and insert --(704°C)--.
In column 9, line 7, after "1,300°F.," delete "(7041 ° C)" and insert --(704°C)--.
In column 9, line 10, after "1,300°F.," delete "(7041 ° C)" and insert --(704°C)--.
In column 9, lines 31-32, after "1,300°F.," delete "(7041 ° C)" and insert --(704°C)--.
In column 9, line 35, after "1,300°F.," delete "(7041 ° C)" and insert --(704°C)--.
In column 10, line 43, line 3 of Claim 19, after "direct", delete "chill" and insert --chill--.
In column 11, line 13, line 2 of Claim 26, before "aluminum" insert --on--.
In column 12, line 7, 1ine 3 of Claim 28, after "alloy" insert -- ; --.

Signed and Sealed this

Eleventh Day of December, 2007

JON W. DUDAS
*Director of the United States Patent and Trademark Office*